US007432903B2

(12) United States Patent
Kato

(10) Patent No.: US 7,432,903 B2
(45) Date of Patent: Oct. 7, 2008

(54) COMMON INVERSION DRIVING TYPE LIQUID CRYSTAL DISPLAY DEVICE AND ITS DRIVING METHOD CAPABLE OF SUPPRESSING COLOR ERRORS

(75) Inventor: Fumihiko Kato, Yamagata (JP)

(73) Assignee: NEC Electronics Corporation, Kanagawa (JP)

( * ) Notice: Subject to any disclaimer, the term of this patent is extended or adjusted under 35 U.S.C. 154(b) by 660 days.

(21) Appl. No.: 10/983,650

(22) Filed: Nov. 9, 2004

(65) Prior Publication Data

US 2005/0140633 A1 Jun. 30, 2005

(30) Foreign Application Priority Data

Nov. 10, 2003 (JP) ..... 2003-380316

(51) Int. Cl.
*G09G 3/36* (2006.01)

(52) U.S. Cl. ..... 345/98

(58) Field of Classification Search ..... 345/87, 345/94, 98–100, 204, 690, 691
See application file for complete search history.

(56) References Cited

U.S. PATENT DOCUMENTS 5,856,816 A * 1/1999 Youn ..... 345/98
2002/0018039 A1 2/2002 Morita
2004/0233184 A1* 11/2004 Toriumi et al. ..... 345/204

FOREIGN PATENT DOCUMENTS

JP 2001-109435 4/2001
JP 2001-337657 12/2001

* cited by examiner

*Primary Examiner*—Amr Awad
*Assistant Examiner*—Stephen G Sherman
(74) *Attorney, Agent, or Firm*—Foley & Lardner LLP

(57) ABSTRACT

In a method for driving a common inversion type liquid crystal display apparatus including a plurality of signal lines, a plurality of scan lines, a common electrode, and a plurality of pixel units, a common voltage applied to the common electrode is inverted for every scan line. Also, digital video signals each including a plurality of digital color signals are time-divisionally received while one of the scan lines is selected. Further, a sequence of the digital video signals including the digital color signals is changed for every two consecutive frames to time-divisionally generate an output sequence of analog video signals including analog color signals, so that each of the analog color signals is placed exclusively at predetermined time slots of the output sequence. Additionally, the output sequence of the analog video signals including the analog color signals are time-divisionally supplied to the signal lines so that the analog color signals are supplied to their corresponding signal lines.

44 Claims, 26 Drawing Sheets

PRIOR ART

HORIZONTAL SHIFT REGISTER CIRCUIT
21
2
22-(m/6)
23-(m/6)
24-(m/6)
DATA REG.
6-TO-1
D/A
22-2
23-2
24-2
22-1
23-1
24-1
3-(m/6)
3-2
3-1
4
POL
VCOM
506
SCAN LINE DRIVER
1
HST
HCK
VT
R
G
B
VST
VCK
SEL1
SEL2
SEL3
SEL4
SEL5
SEL6
SL1
SL2
SL6
SLm
SLm-1
GL1
GL2
GLn
(R1)
(G1)
(B1)
(R2)
(G2)
(B2)
(Gm/3)
(Bm/3)

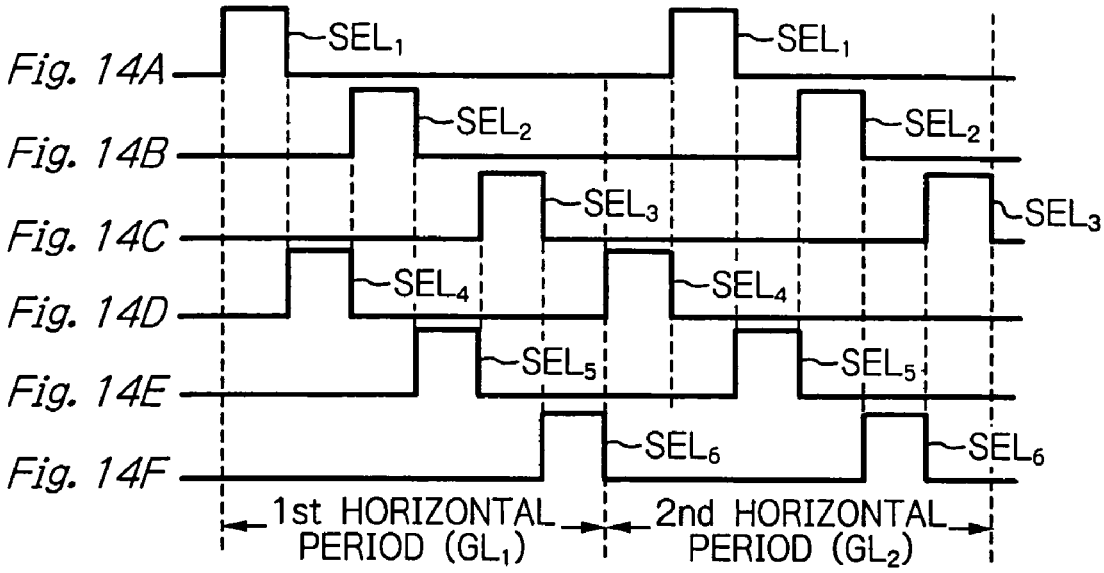
N-th & (N+1)-th FRAMES
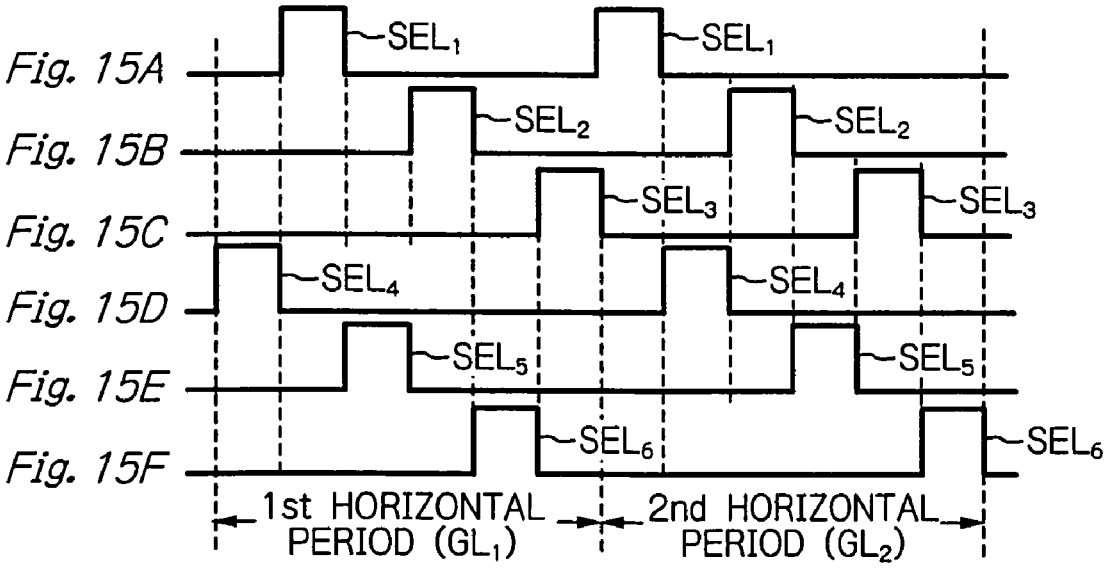
(N+2)-th & (N+3)-th FRAMES

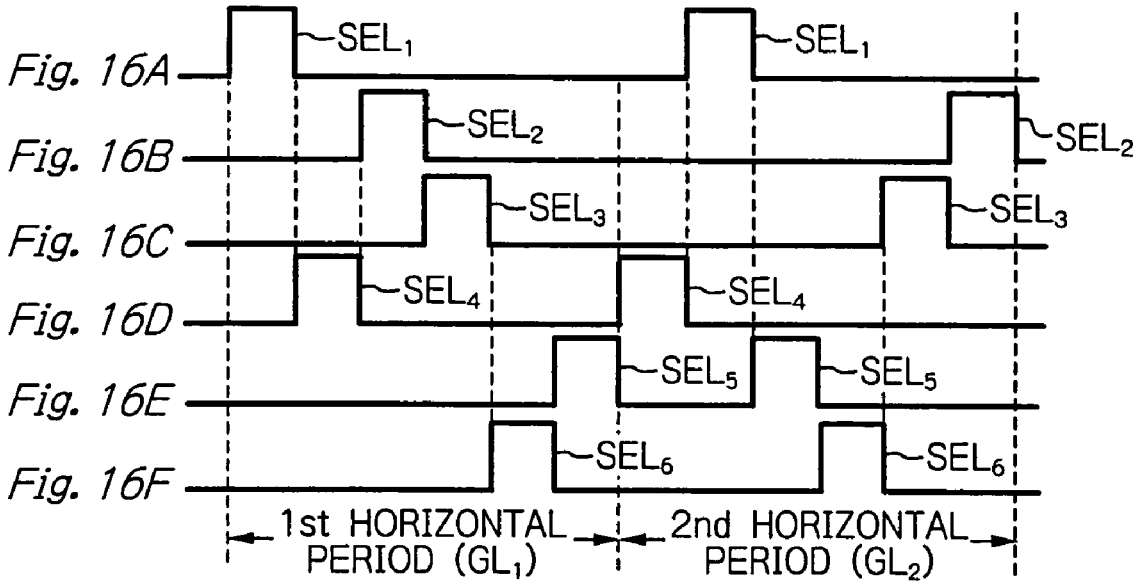
N-th & (N+1)-th FRAMES
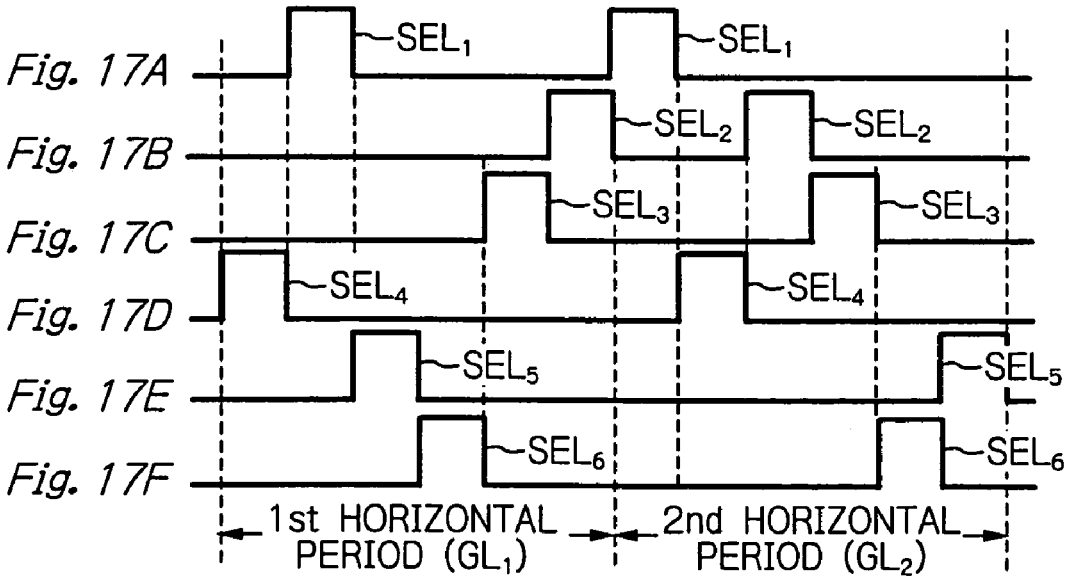
(N+2)-th & (N+3)-th FRAMES

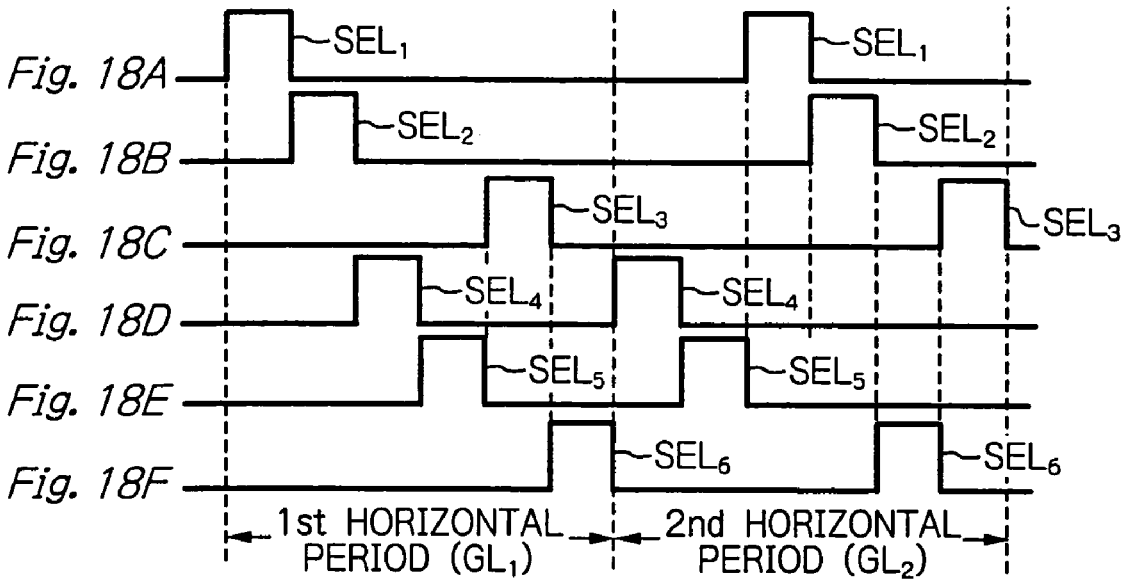
N-th & (N+1)-th FRAMES
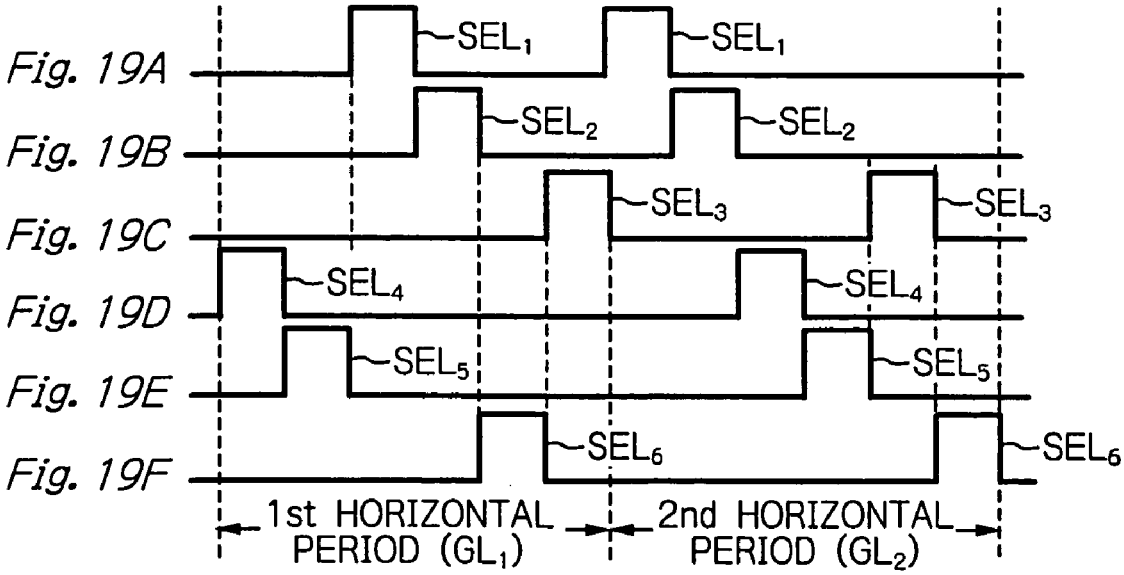
(N+2)-th & (N+3)-th FRAMES

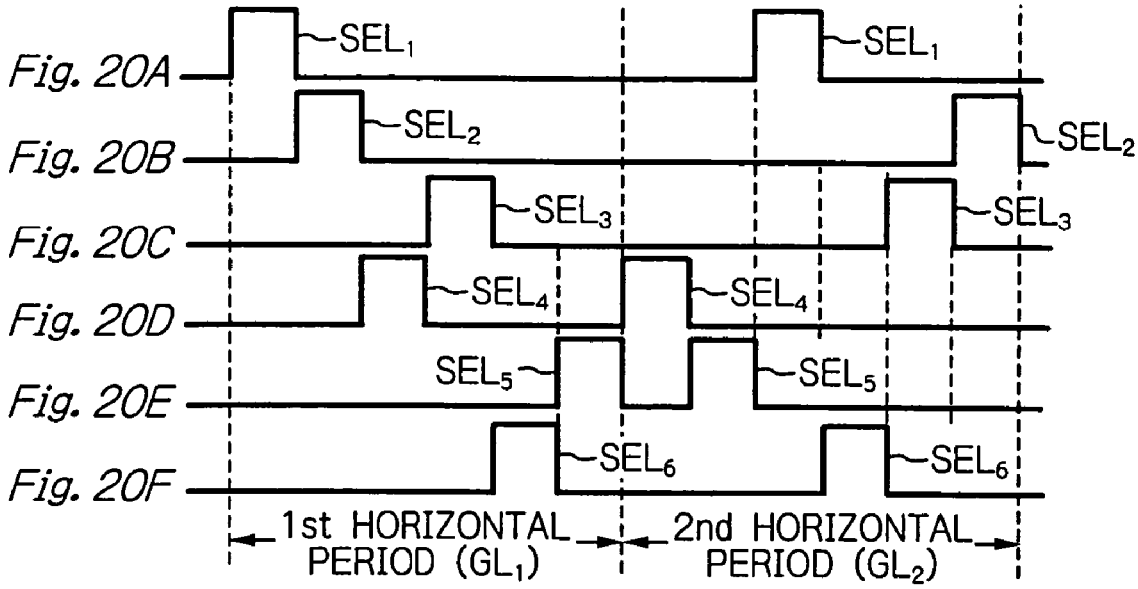
N-th & (N+1)-th FRAMES
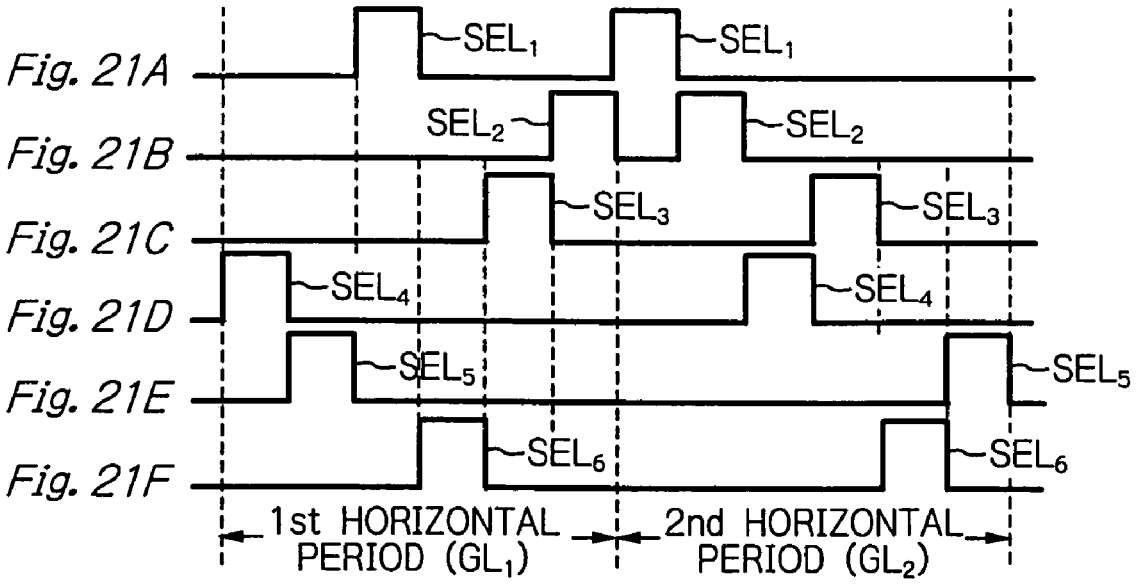
(N+2)-th & (N+3)-th FRAMES

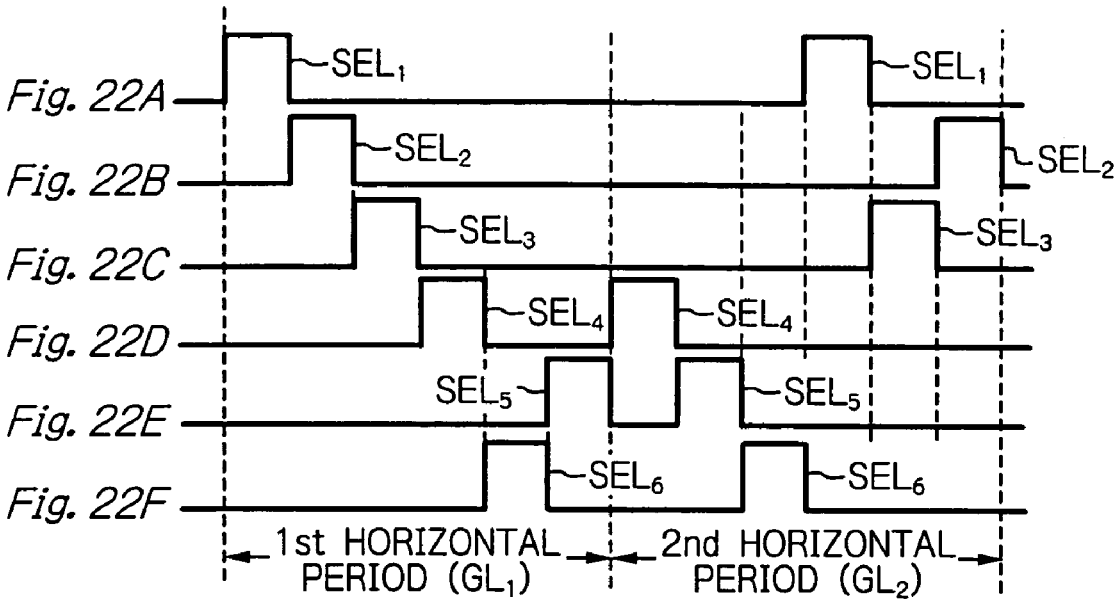
N-th & (N+1)-th FRAMES
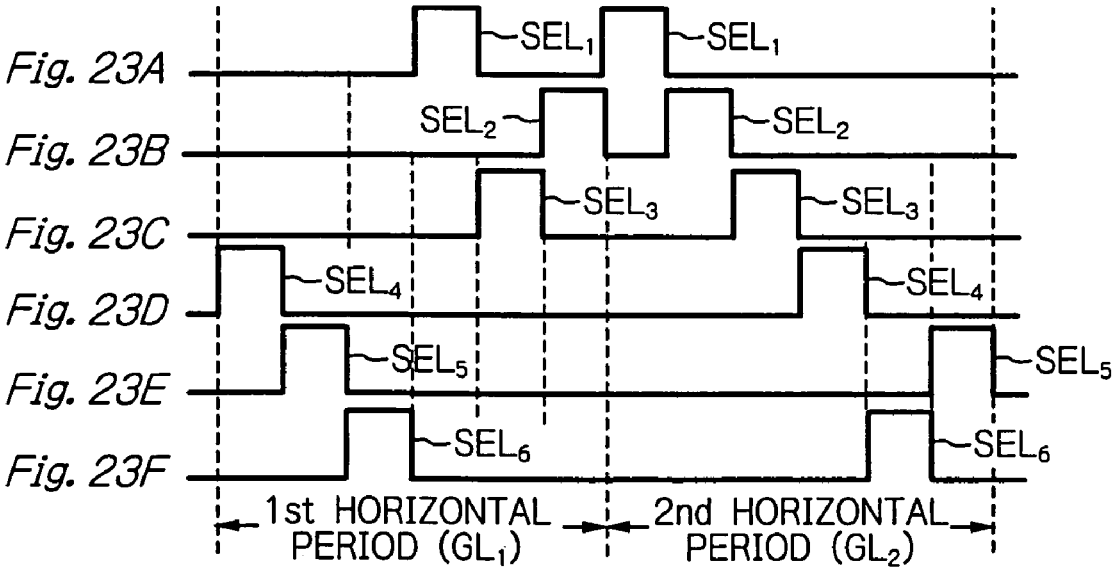
(N+2)-th & (N+3)-th FRAMES

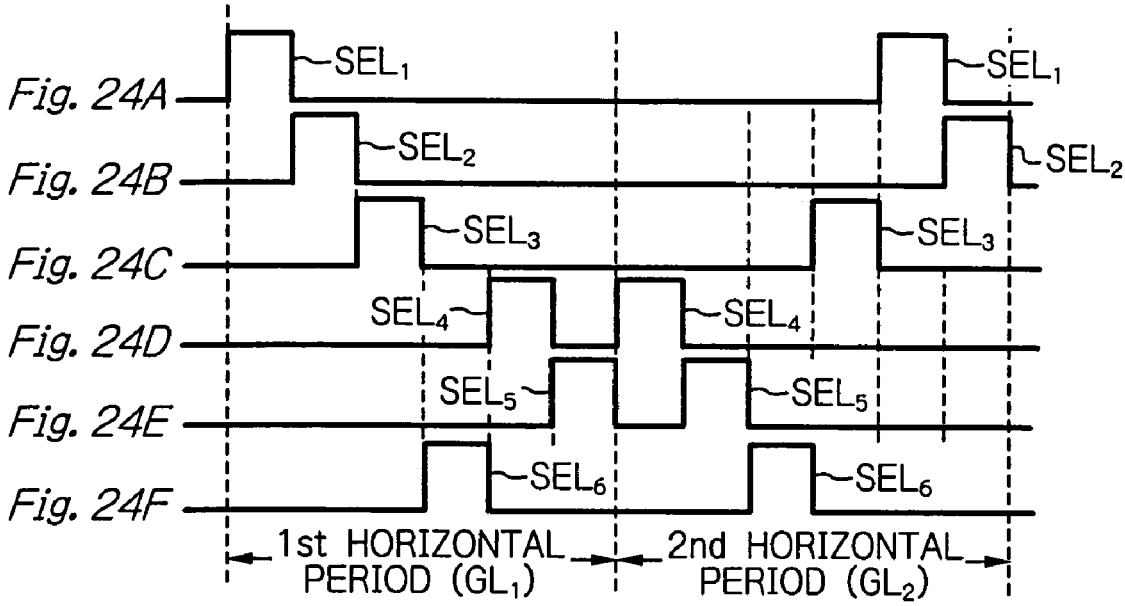
N-th & (N+1)-th FRAMES
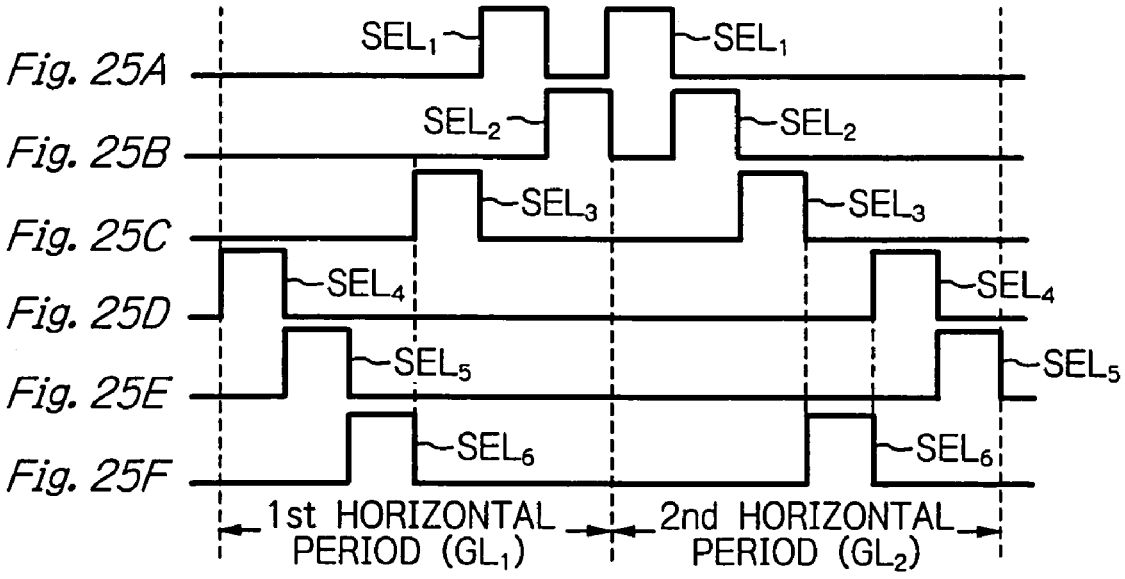
(N+2)-th & (N+3)-th FRAMES

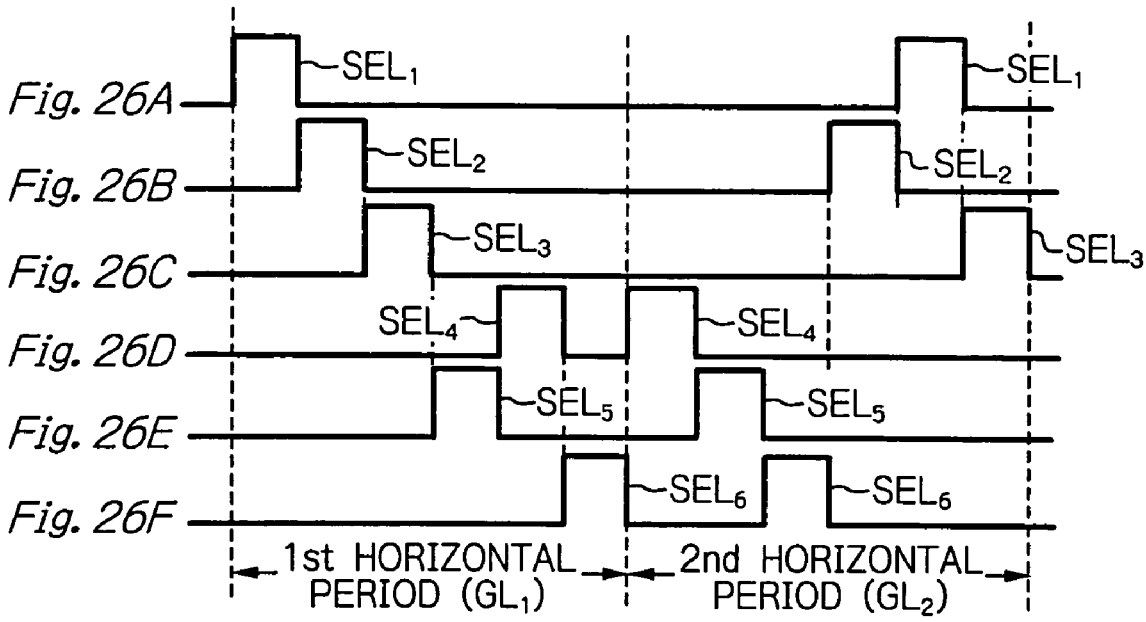
N-th & (N+1)-th FRAMES
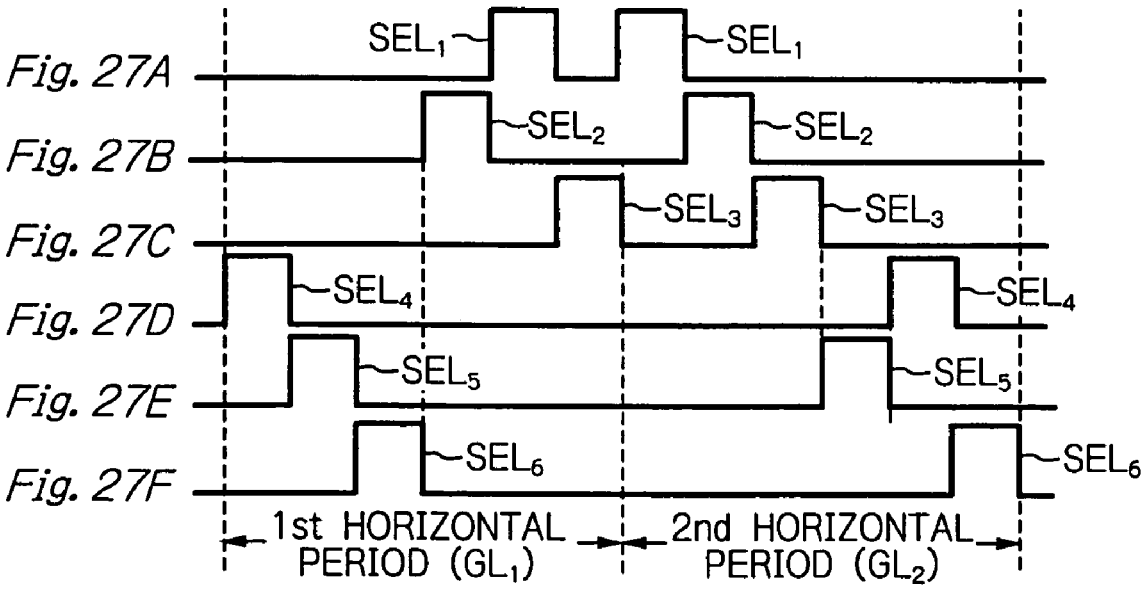
(N+2)-th & (N+3)-th FRAMES

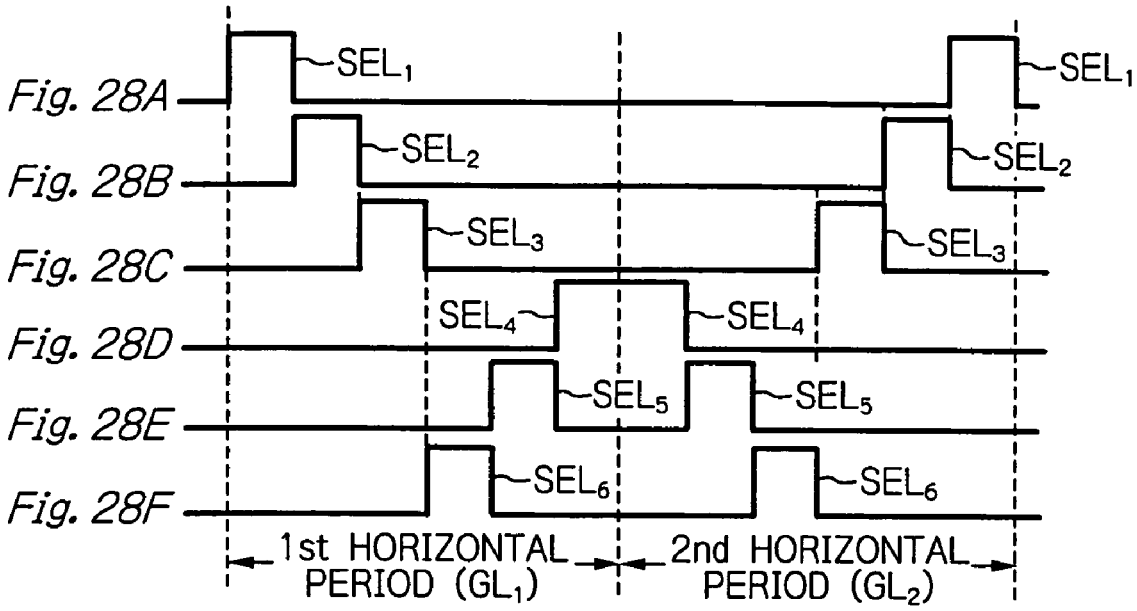
N-th & (N+1)-th FRAMES
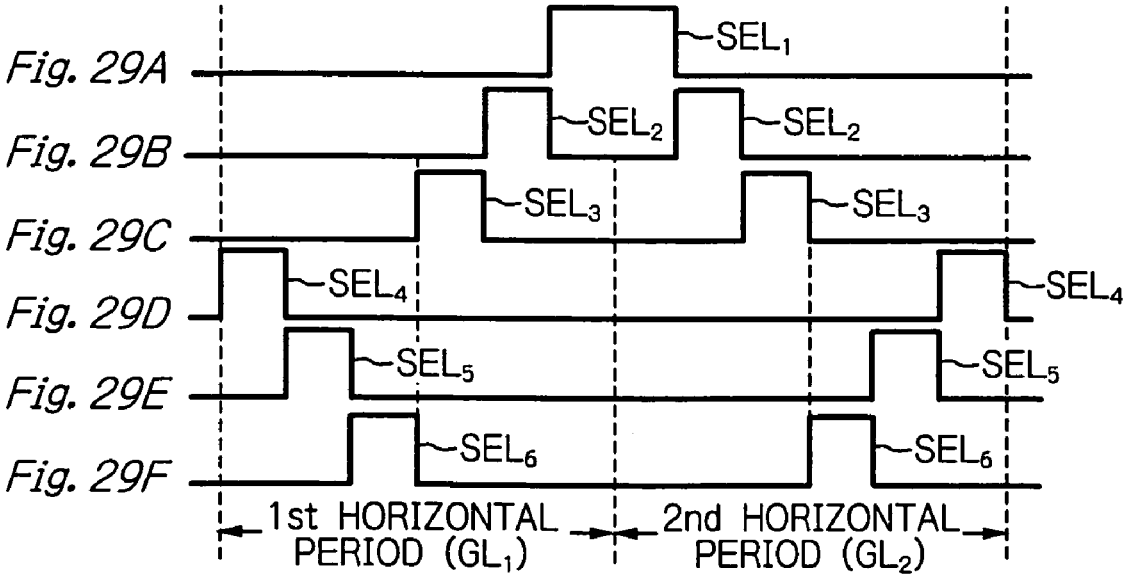
(N+2)-th & (N+3)-th FRAMES

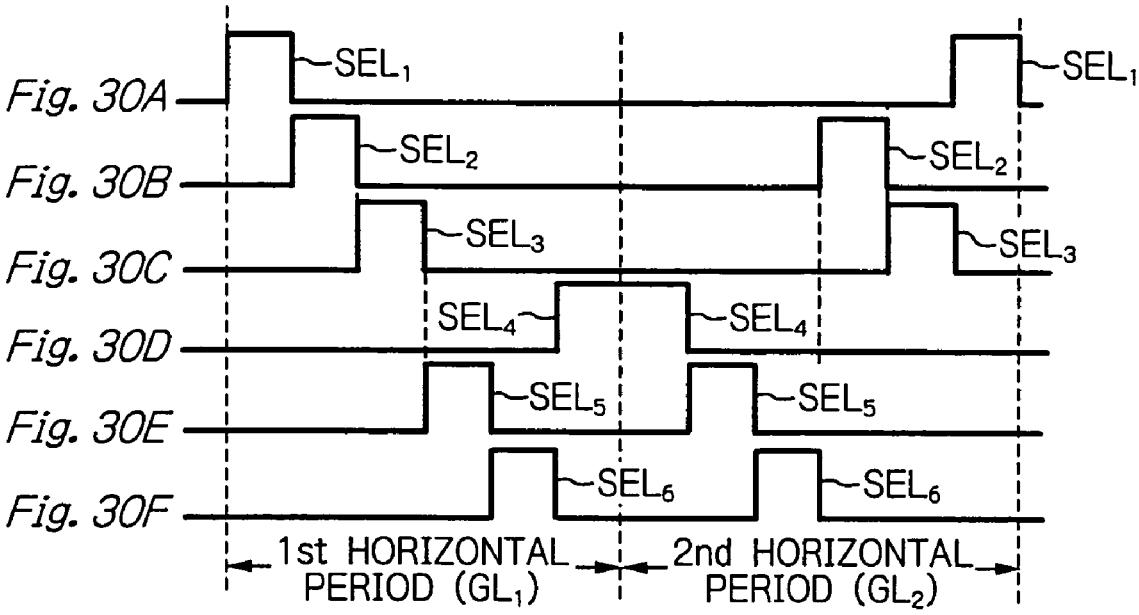
N-th & (N+1)-th FRAMES
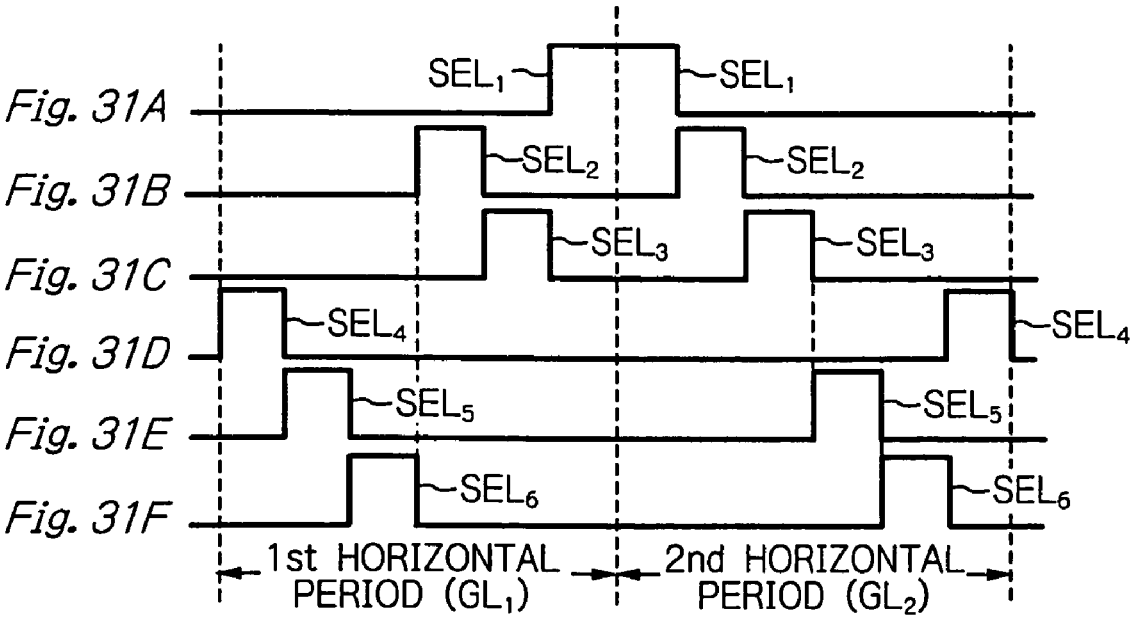
(N+2)-th & (N+3)-th FRAMES

COMMON INVERSION DRIVING TYPE LIQUID CRYSTAL DISPLAY DEVICE AND ITS DRIVING METHOD CAPABLE OF SUPPRESSING COLOR ERRORS

BACKGROUND OF THE INVENTION

1. Field of the Invention

The present invention relates to a common inversion driving type liquid crystal display (LCD) device and its driving method.

2. Description of the Related Art

Generally, an LCD apparatus is constructed by an amorphous silicon panel including a plurality of signal lines (or data lines) arranged along a column direction, a plurality of scan lines (or gate lines) arranged along a row direction, a plurality of active pixel units each including one thin film transistor (TFT) made of amorphous silicon and one pixel capacitor located at intersections between the signal lines and the scan lines, a signal line driver formed on a flexible printed board called a tape carrier package (TCP) connected to the panel, and a scan line driver formed on another flexible printed board (TCP) connected to the panel. However, as the capacity of the panel has been increased, it is difficult to connect the signal line driver and the scan line driver to the panel due to the narrow pitch of the scan lines and the signal lines.

Recently, TFTs made of polycrystalline silicon formed on a glass substrate by a low-temperature chemical vapor deposition (CVD) process have been used in the above-mentioned panel, so that the entire or part of a signal line driver and a scan line driver can be introduced into the panel. Thus, it is easy to connect the signal line driver and the scan line driver to the panel, or it is unnecessary to connect the signal line driver and the scan line driver to the panel. In this case, however, the glass substrate of the panel becomes very large, which would increase the manufacturing cost and decrease the reliability.

A first prior art LCD apparatus (see: JP-2001-109435-A) is constructed by a polycrystalline silicon panel including a plurality of signal lines, a plurality of scan lines, a plurality of active pixel units located at intersections between the signal lines and the scan lines and a scan line driver by using polycrystalline silicon formed on a glass substrate by a low-temperature CVD process, and a signal line driver formed on a flexible printed board (TCP). Also, the first prior art LCD apparatus is constructed by a selector circuit connected between the signal line driver and the amorphous silicon panel to time-divisionally connect the signal line driver to the signal lines. In this case, the selector circuit is formed in the polycrystalline silicon panel, so that the number of connections between the signal line driver (TCP) and the polycrystalline silicon panel is decreased. Thus, it is easy to connect the signal line driver to the polycrystalline silicon panel. This will be explained later in detail.

A second prior art LCD apparatus (see: JP-2001-337657-A) is constructed by a polycrystalline silicon panel including a plurality of signal lines, a plurality of scan lines, a plurality of active pixel units located at intersections between the signal lines and the scan lines, a signal line driver and a scan line driver by using polycrystalline silicon formed on a glass substrate by a low-temperature CVD process. Also, the second prior art LCD apparatus is constructed by a selector circuit connected between the signal line driver and the polycrystalline silicon panel to time-divisionally connect the signal line driver to the signal lines. In this case, the selector circuit is formed in the polycrystalline silicon panel, so that the signal line driver is decreased in size. This will be explained later in detail.

On the other hand, in order to avoid a so-called residual image phenomenon, the polarity of voltages at the signal lines is inverted with respect to the voltage at a common electrode for every frame, which is called a frame inversion driving method. Also, in order to avoid the flicker due to the frame inversion driving method, a horizontal inversion driving method, a vertical inversion driving method or a dot inversion driving method is carried out. In the horizontal line inversion driving method, the polarities of voltages at the signal lines are inverted with respect to the voltage at the common electrode for every scan line. Also, in the vertical line inversion driving method, the polarities of voltages at the signal lines are inverted with respect to the voltage at the common electrode for every signal line. Further, in the dot inversion driving method, the polarities of voltages at the signal lines are inverted for every dot (video signal). However, the amplitude of the voltages at the signal lines in the frame, horizontal, vertical and dot inversion driving methods is twice that in a non-inversion driving method, which requires higher breakdown characteristics of the signal line driver. In order to decrease the amplitude of the voltages at the signal lines in the frame, horizontal, vertical and dot inversion driving methods, a common inversion driving method is adopted to invert the polarity of the voltage at the common electrode in synchronization with the inversion timings of the frame, horizontal, vertical and dot inversion driving methods.

When the common inversion driving method as well as at least one of the frame, horizontal, vertical and dot inversion driving methods is applied to the above-mentioned first and second prior art LCD apparatuses, since the voltage at the common electrode has a transient phenomenon, the difference in voltage between the signal lines time-divisionally driven by the signal line driver and the common electrode is affected by the transient phenomenon of the voltage at the common electrode.

SUMMARY OF THE INVENTION

It is an object of the present invention to provide a common inversion type LCD apparatus and its driving method capable of suppressing the affect of the transient phenomenon, particularly, suppressing the color errors and the residual DC component in liquid crystal.

According to the present invention, in a common inversion type liquid crystal display apparatus including a plurality of signal lines, a plurality of scan lines, a common electrode, a plurality of pixel units located at intersections between the signal lines and the scan lines and connected to the common electrode, a common voltage generating circuit, connected to the common electrode, for inverting a common voltage applied to the common electrode for every frame and every scan line, and a scan line driver, connected to the scan lines, for sequentially selecting the scan lines, a signal line driver connected to the signal lines time-divisionally receives digital video signals each including a plurality of digital color signals and changes a sequence of the digital video signals including the digital color signals for every two consecutive frames to time-divisionally generate an output sequence of analog video signals including analog color signals, so that each of the analog color signals is placed exclusively at predetermined time slots of said output sequence. A selector circuit connected between the signal line driver and the signal lines time-divisionally supplies the output sequence of the analog video signals including the analog color signals to the signal lines so that the analog color signals are supplied to their corresponding signal lines.

Also, in a common inversion type liquid crystal display apparatus including a plurality of signal lines, a plurality of scan lines, a common electrode, a plurality of pixel units located at intersections between the signal lines and the scan lines and connected to the common electrode, a common voltage generating circuit, connected to the common electrode, for inverting a common voltage applied to the common electrode for every predetermined number of signal lines, and a scan line driver, connected to the scan lines, for sequentially selecting the scan lines, a signal line driver connected to the signal lines time-divisionally receives digital video signals each including a predetermined number of digital color signals to time-divisionally generate an output sequence of analog video signals including analog color signals, so that each of the analog color signals is placed exclusively at a predetermined time slot of the output sequence. A selector circuit connected between the signal line driver and the signal lines time-divisionally supplies the output sequence of the analog video signals including the analog color signals to the signal lines so that the analog color signals are supplied to their corresponding signal lines.

Further, in a common inversion type liquid crystal display apparatus including a plurality of signal lines, a plurality of scan lines, a common electrode, a plurality of pixel units located at intersections between the signal lines and the scan lines and connected to the common electrode, a common voltage generating circuit, connected to the common electrode, for inverting a common voltage applied to the common electrode for every predetermined number of signal lines, and a scan line driver, connected to the scan lines, for sequentially selecting the scan lines, a signal line driver connected to the signal lines time-divisionally receives digital video signals each including the predetermined number of digital color signals and changes a sequence of every two consecutive digital video signals for every scan line to time-divisionally generate an output sequence of analog video signals including analog color signals, so that each of the analog color signals is placed exclusively at predetermined time slots of the output sequence. A selector circuit connected between the signal line driver and the signal lines time-divisionally supplies the output sequence of the analog video signals including the analog color signals to the signal lines so that the analog color signals are supplied to their corresponding signal lines.

BRIEF DESCRIPTION OF THE DRAWINGS

The present invention will be more clearly understood from the description set forth below, as compared with the prior art, with reference to the accompanying drawings, wherein:

FIGS. 14A through 14F, 15A through 15F, 16A through 16F, 17A through 17F, 18A through 18F, 19A through 19F, 20A through 20F, 21A through 21F, 22A through 22F, 23A through 23F, 24A through 24F, 25A through 25F, 26A through 26F, 27A through 27F, 28A through 28F, 29A through 29F, 30A through 30F and 31A through 31F are timing diagrams for explaining modifications of the first operation of FIGS. 10A through 10H, 11A through 11H, 12A through 12H and 13A through 13H;

DESCRIPTION OF THE PREFERRED EMBODIMENT

Before the description of the preferred embodiment, prior art LCD apparatuses will be explained with reference to FIGS. 1, 2, 3A, 3B, 3C, 4A, 4B, 4C, 5, 6A through 6H, and 7A through 7H.

Figure 1:
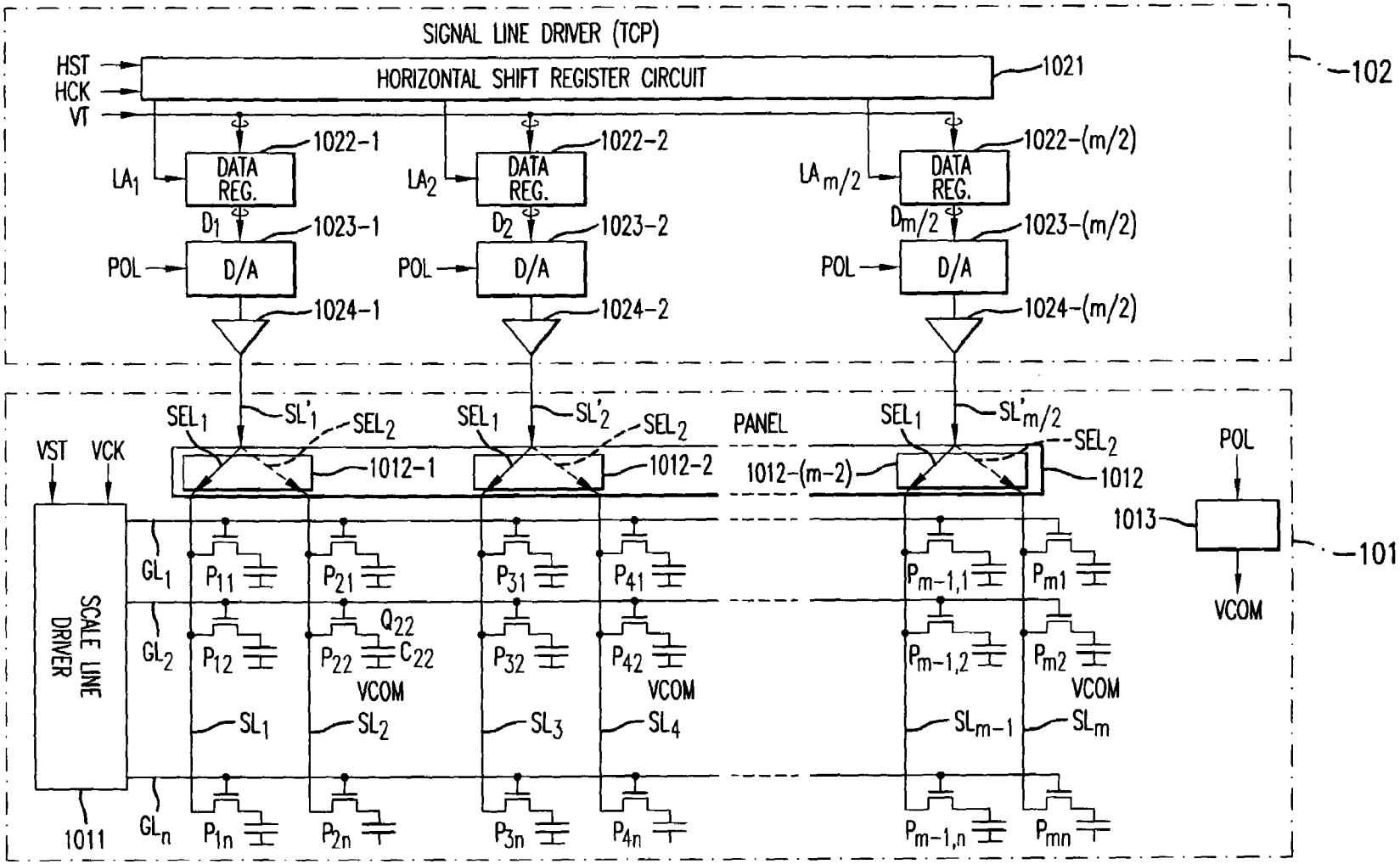
FIG. 1 PRIOR ART
FIG. 1 is a block circuit diagram illustrating a first prior art LCD apparatus.

In FIG. 1, which illustrates a first prior art LCD apparatus (see: JP-2001-109435-A), reference numeral 101 designates an m×n-dot panel formed by a polycrystalline silicon on a glass substrate by using a low temperature CVD process. The panel 101 includes m signal lines $SL_1, SL_2, \ldots, SL_m$, n scan lines $GL_1, GL_2 \ldots, GL_n$, m×n pixel units $P_{11}, P_{12}, \ldots, P_{mn}$ located at intersections between the signal lines $SL_1, SL_2, \ldots, SL_m$ and the scan lines $GL_1, GL_2 \ldots, GL_n$. Each of the pixel units $P_{11}, P_{12}, \ldots, P_{mn}$ is constructed by one TFT such as $Q_{22}$ and one pixel capacitor such as $C_{22}$ including liquid crystal connected to the TFT $Q_{22}$ and a common electrode to which a common voltage VCOM is applied. The panel 101 also includes a scan line driver 1011 which is constructed by a vertical shift register circuit for shifting a vertical start pulse signal VST in synchronization with a vertical clock signal VCK to sequentially generate scan line signals on the scan lines $GL_1, GL_2 \ldots, GL_n$. The panel 101 further includes a selector circuit 1012 formed by 1-to-2 multiplexers 1012-1, 1012-2, . . . , 1012-(m/2) between the signal lines $SL_1, SL_2, SL_3, SL_4, \ldots, SL_{m-1}, SL_m$ and signal lines $SL_1', SL_2', \ldots, SL_{m/2}'$ Additionally, the panel 101 includes a common voltage generating circuit 1013 for generating the common voltage VCOM in synchronization with a polarity signal POL. Note that the common voltage generating circuit 1013 is not disclosed in JP-2001-109435-A.

Also, in FIG. 1, reference numeral 102 designates a signal line driver formed on a flexible printed board. The signal line driver 102 is constructed by a horizontal shift register circuit 1021 for shifting a horizontal start pulse signal HST in synchronization with a horizontal clock signal HCK to sequentially generate latch signals $LA_1, LA_2 \ldots, LA_{m/2}$, data registers 1022-1, 1022-2, . . . , 1022-(m/2) for latching a digital gradation video signal VD in synchronization with the latch signals $LA_1, LA_2 \ldots, LA_{m/2}$, respectively, to generate digital video signals $D_1, D_2 \ldots, D_{m/2}$, digital/analog (D/A) converters 1023-1, 1023-2, . . . , 1-23-(m/2) for performing D/A conversions upon the digital video signals $D_1$, $D_2$ . . . , $D_{m/2}$, respectively, and drivers 1024-1, 1024-2, . . . , 1024-(m/2) for amplifying analog output voltages of the D/A converters 1023-1, 1023-2, . . . , 1023-(m/2), to supply them to the corresponding signal lines $SL_1'$, $SL_2'$, . . . , $SL_{m/2}'$. In this case, each of the D/A converters 1023-1, 1023-2, . . . , 1023-(m/2) is formed by two D/A conversion units for the positive side and the negative side which are selected in accordance with the polarity signal POL.

In FIG. 1, when a selection signal $SEL_1$(="1") is supplied to the selector circuit 1012, the 1-to-2 multiplexers 1012-1, 1012-2, 1012-(m/2) connect the signal lines $SL_1'$, $SL_2'$, . . . , $SL_{m/2}'$ to the signal lines $SL_1$, $SL_3$, . . . , $SL_{m-1}$, respectively. On the other hand, when a selection signal $SEL_2$(="1") is supplied to the selector circuit 1012, the 1-to-2 multiplexers 1012-1, 1012-2, . . . , 1012-(m/2) connect the signal lines $SL_1'$, $SL_2'$, . . . , $SL_{m/2}'$ to the signal lines $SL_2$, $SL_4$, . . . , $SL_m$, respectively. Therefore, when the selection signals $SEL_1$ and $SEL_2$ are time-divisionally supplied to the selection circuit 1012, the selection circuit 1012 time-divisionally connects the signal lines $SL_1'$, $SL_2'$, . . . , $SL_{m/2}'$ to the signal lines $SL_1$, $SL_2$, $SL_3$, $SL_4$, . . . , $SL_{m-1}$, $SL_m$, so that analog video signals are supplied to the signal lines $SL_1$, $SL_2$, $SL_3$, $SL_4$, . . . , $SL_{m-1}$, $SL_m$. Therefore, as the substantial number of signal lines connected to the signal line driver 102 is decreased to one half, it is easy to connect the signal line driver (flexible printed board) 102 to the panel 101. Also, since the number of registers of the horizontal shift register circuit, the number of data registers, the number of D/A converters and the number of drivers can be decreased, the signal line driver 102 can be small in size.

Note that, if the time division number of the selector circuit 1012 is 3 or more, the substantial number of signal lines will be further decreased, so that it is easier to connect the signal line driver 102 to the panel 101, and the signal line driver 102 can be further decreased in size.

Figure 2:
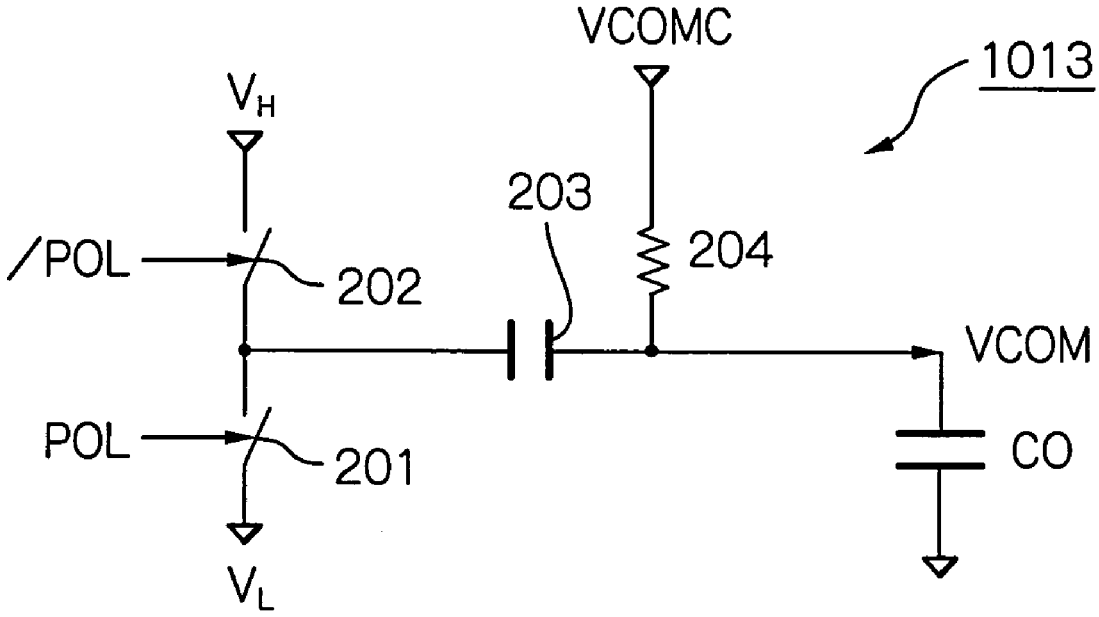
Fig. 2 PRIOR ART
FIG. 2 is a detailed circuit diagram of the common voltage generating circuit of FIG. 1.
Figures 3A, 3B, 3C:
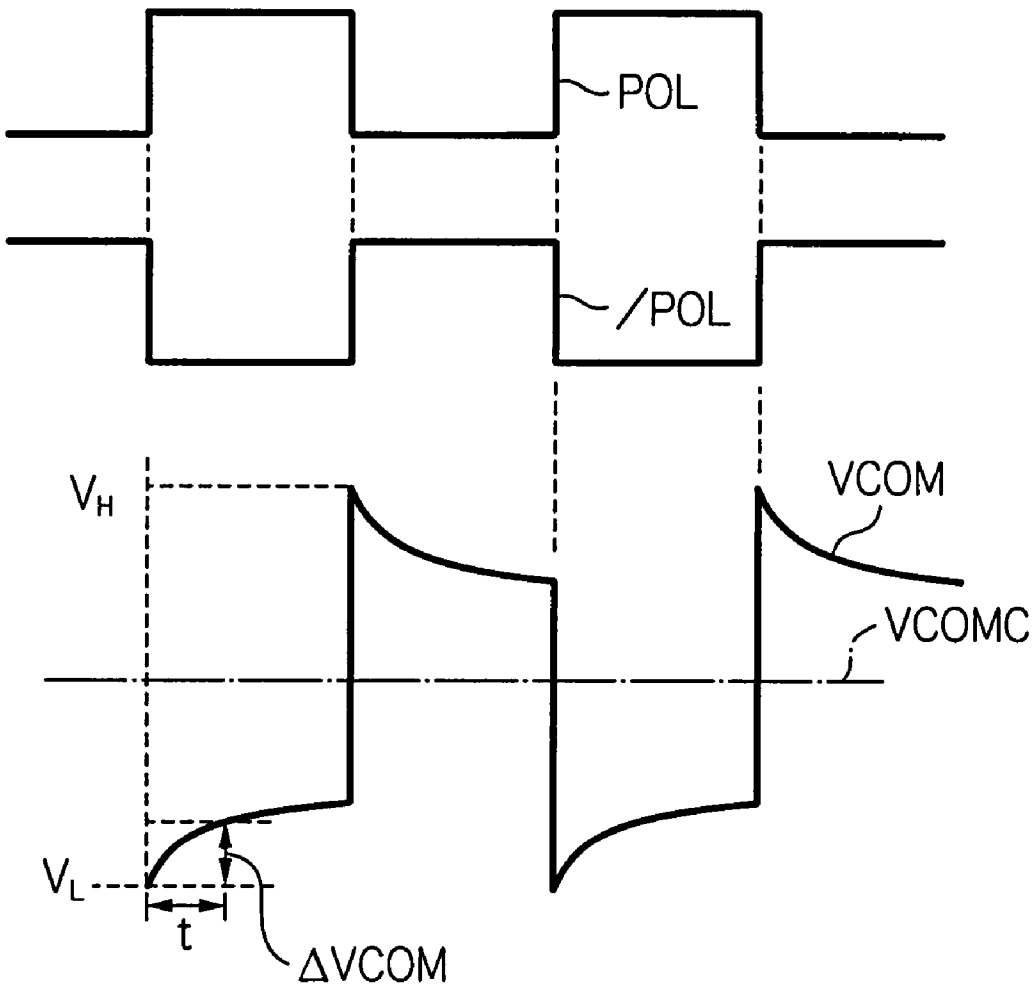
FIGS. 3A, 3B and 3C are timing diagrams for explaining the operation of the common voltage generating circuit of FIG. 2.

In FIG. 2, which is a detailed circuit diagram of the common voltage generating circuit 1013 of FIG. 1, the common voltage generating circuit 1013 is constructed by switches 201 and 202 turned ON by the polarity signal POL and its inverted signal/POL, respectively, a capacitor 203, and a resistor 204 to which a center voltage VCOMC is applied. Note that $V_H$ and $V_L$ are a high level voltage and a low level voltage, respectively. Therefore, when the polarity signal POL and its inverted signal/POL are changed as shown in FIGS. 3A and 3B, the common voltage VCOM is changed as shown in FIG. 3C. That is, the common voltage VCOM has a transient characteristic represented by $$\Delta VCOM=\{1-\exp(-t/((C+CO)\cdot r))\}\cdot VCOMC$$

where C is a capacitance of the capacitor 203;

CO is a capacitance of the common electrode (not shown); and r is a resistance of the resistor 204.

Figures 4A, 4B, 4C, 4D:
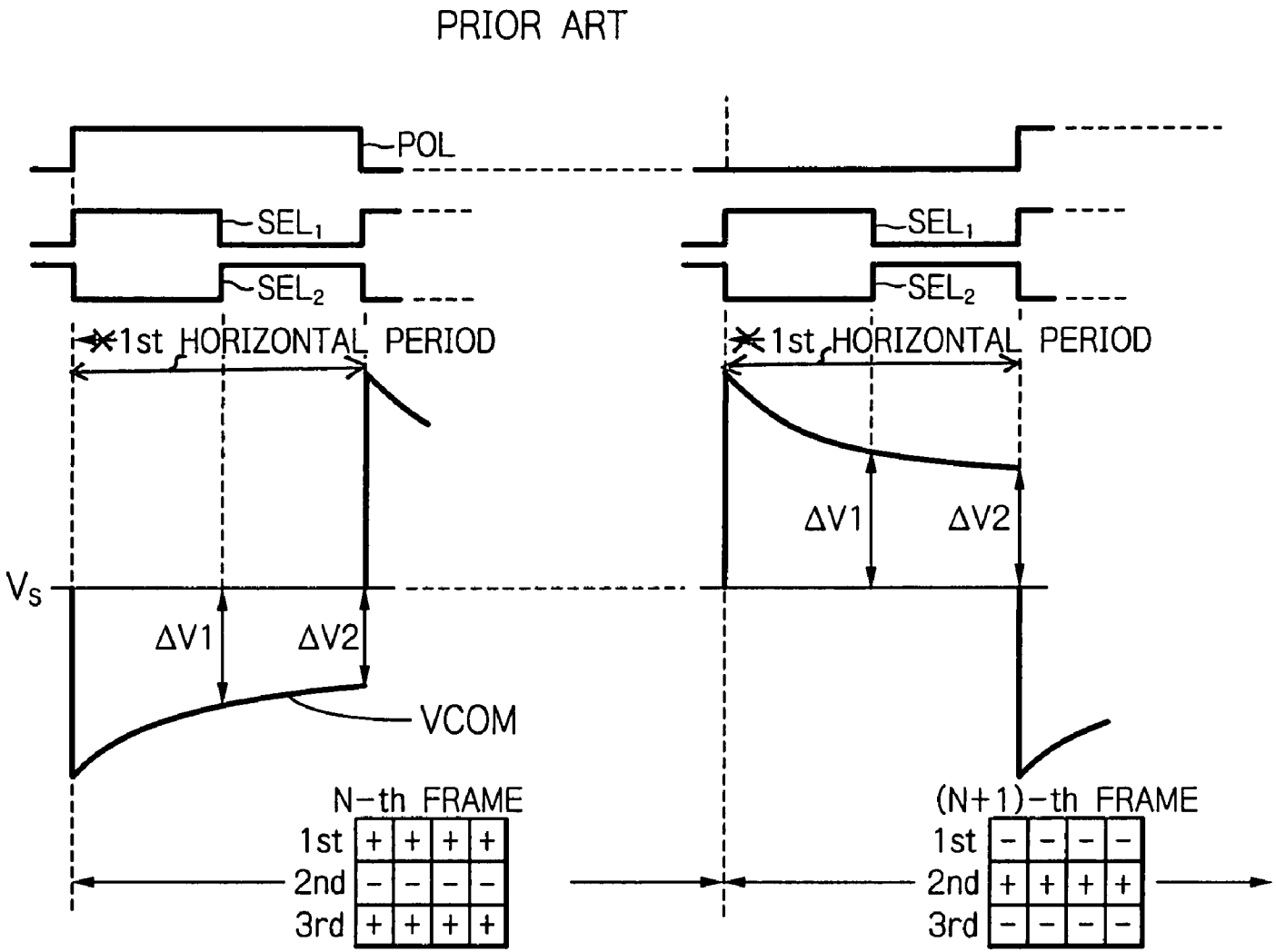
FIGS. 4A, 4B, 4C and 4D are timing diagrams for explaining the operation of the LCD apparatus of FIG. 1.

Here, assume that the same analog video voltage $V_s$ is time-divisionally applied to the pixel units $P_{11}$ and $P_{21}$ by the polarity signal POL, and the selection signals $SEL_1$ and $SEL_2$ are as shown in FIGS. 4A, 4B and 4C where a frame and horizontal inversion driving method is carried out. In this case, an electric field of the liquid crystal of the pixel unit $P_{11}$ is determined by ΔV1 as shown in FIG. 4D, and an electric field of the liquid crystal of the pixel unit $P_{21}$ is determined by ΔV2 (<ΔV1) as shown in FIG. 4D. However, the difference between ΔV1 and ΔV2 cannot be compensated for by the LCD apparatus of FIG. 1.

Figure 5:
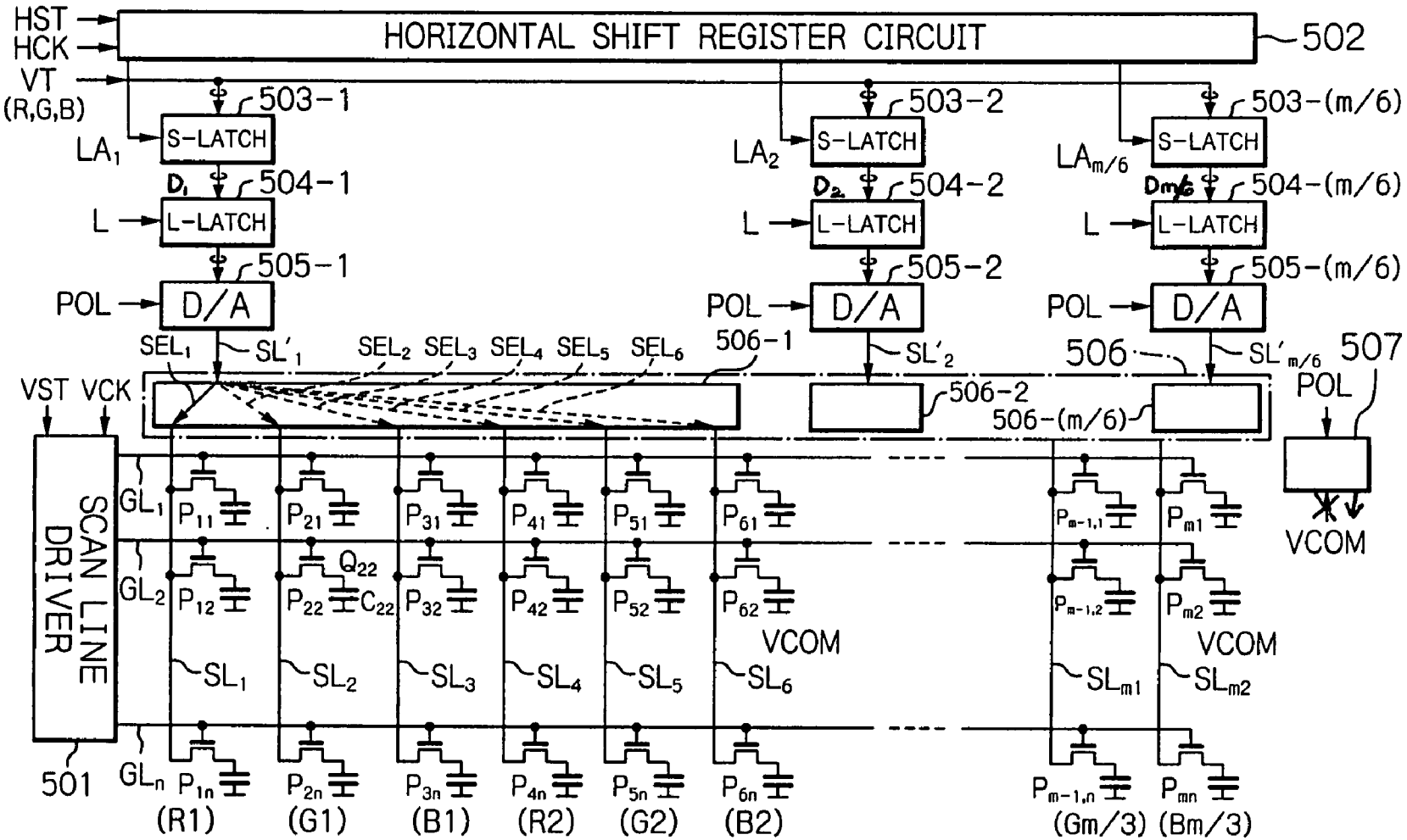
Fig. 5 PRIOR ART
FIG. 5 is a block circuit diagram illustrating a second prior art LCD apparatus.
Figures 6A, 6B, 6C, 6D, 6E, 6F, 6G, 6H:
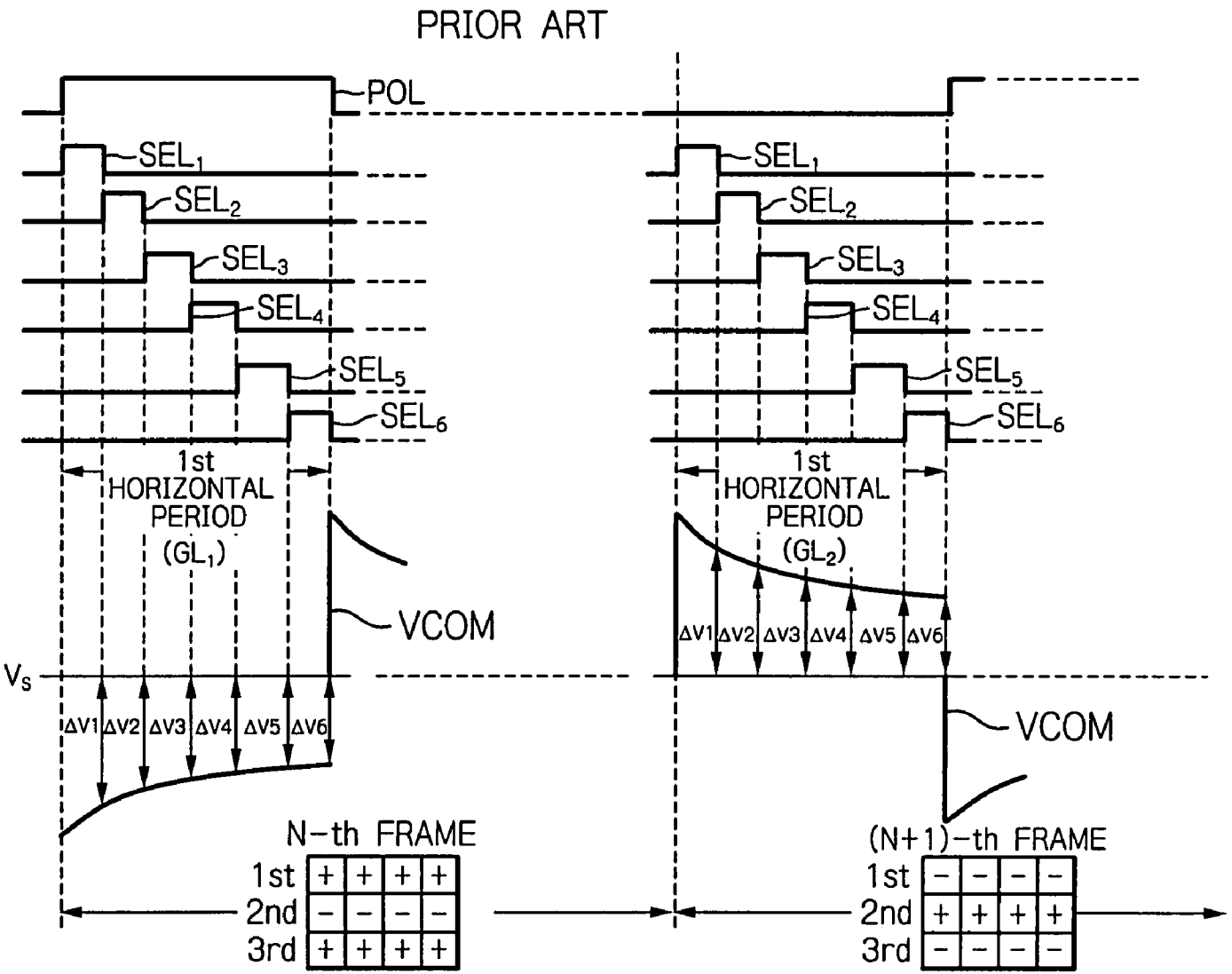
FIGS. 6A through 6H and FIGS. 7A through 7H are timing diagrams for explaining the operation of the LCD apparatus of FIG. 5.
Figures 7A, 7B, 7C, 7D, 7E, 7F, 7G, 7H:
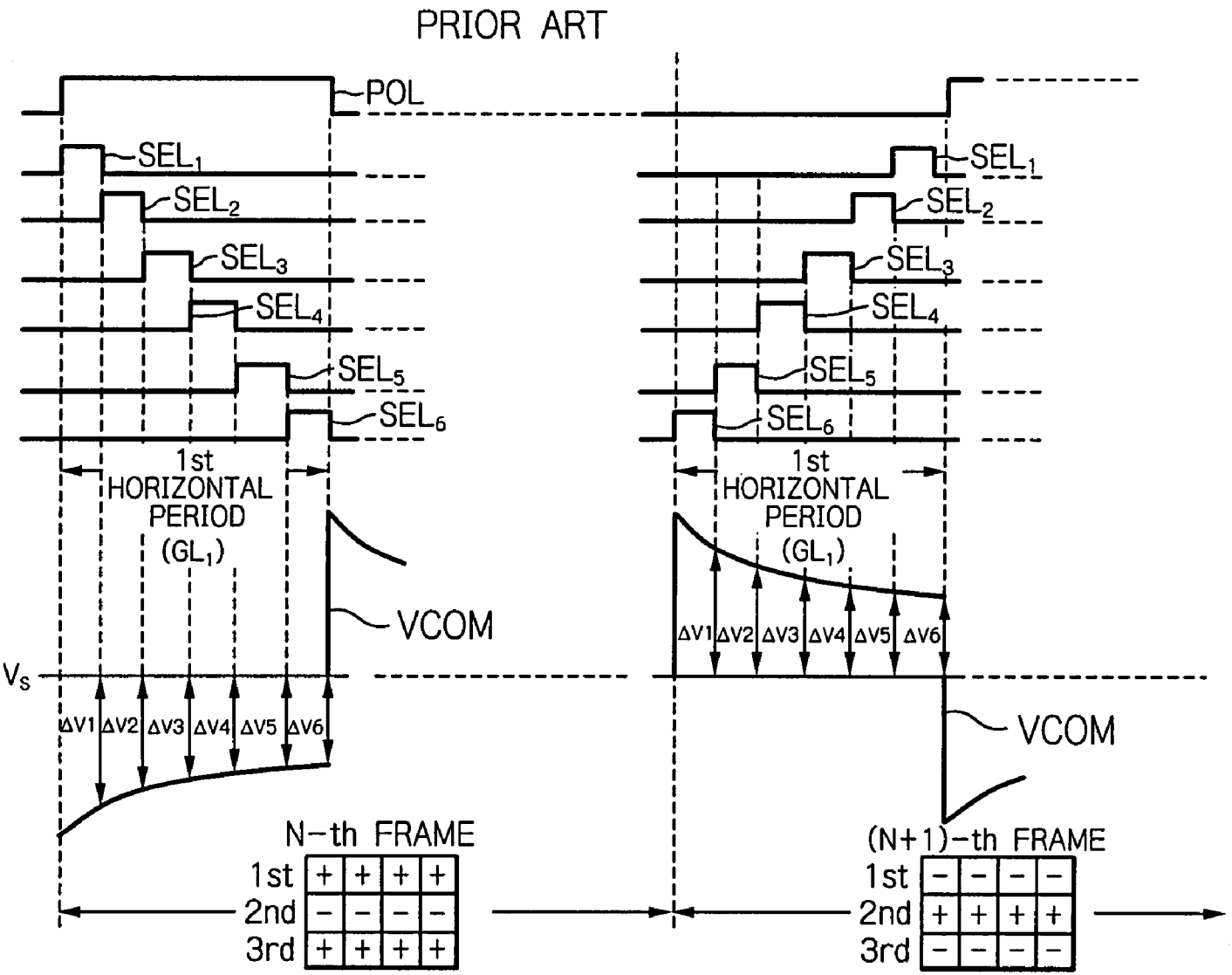

In FIG. 5, which illustrates a second prior art LCD apparatus (see: JP-2001-337657-A), the entire LCD apparatus is incorporated into an m×n-dot panel formed by a polycrystalline silicon on a glass substrate by using a low temperature CVD process. That is, the panel includes m signal lines $SL_1$, $SL_2$, . . . , $SL_m$, n scan lines $GL_1$, $GL_2$ . . . , $GL_n$, m×n pixel units $P_{11}$, $P_{12}$, . . . , $P_{mn}$ located at intersections between the signal lines $SL_1$, $SL_2$, . . . , $SL_m$ and the scan lines $GL_1$, $GL_2$ . . . , $GL_n$. Each of the pixel units $P_{11}$, $P_{12}$, . . . , $P_{mn}$ is constructed by one TFT such as $Q_{22}$ and one pixel capacitor such as $C_{22}$ including liquid crystal connected to the TFT $Q_{22}$ and a common electrode to which a common voltage VCOM is applied. The panel also includes a scan line driver 501 which is constructed by a vertical shift register circuit for shifting a vertical start pulse signal VST in synchronization with a vertical clock signal VCK to sequentially generate scan line signals on the scan lines $GL_1$, $GL_2$ . . . , $GL_n$.

The panel also includes a signal line driver which is constructed by a horizontal shift register circuit 502 for shifting a horizontal start pulse signal HST in synchronization with a horizontal clock signal HCK to sequentially generate latch signals $LA_1$, $LA_2$ . . . , $LA_{m/6}$, sampling latch circuits 503-1, 503-2, . . . , 503-(m/6) for latching a digital gradation video signal VD formed by a red signal (R), a green signal (G) and a blue signal (B) in synchronization with the latch signals $LA_1$, $LA_2$ . . . , $LA_{m/6}$, respectively, to generate digital video signals $D_1$, $D_2$ . . . , $D_{m/6}$, load latch circuit 504-1, 504-2, . . . , 504-(m/6) for latching the digital gradation video signal VD of the sampling latch circuits 503-1, 503-2, . . . , 503-(m/6), respectively, in synchronization with a load signal L, and D/A converters 505-1, 505-2, . . . , 505-(m/6) for performing D/A conversions upon the digital video signals of the load latch circuit 504-1, 504-2, . . . , 504-(m/6), respectively, to supply them to signal lines $SL_1'$, $SL_2'$, . . . , $SL_{m/6}'$. Also in this case, each of the D/A converters 505-1, 505-2, . . . , 505-(m/6) is formed by two D/A conversion units for the positive side and the negative side which are selected in accordance with a polarity signal POL.

The panel further includes a selector circuit 506 formed by 1-to-6 multiplexers 506-1, 506-2, . . . , 506-(m/6) between the signal lines $SL_1'$, $SL_2'$, . . . , $SL_{m/6}'$ and the signal lines $SL_1$, $SL_2$, $SL_3$, $SL_4$, . . . , $SL_{m-1}$, $SL_m$.

Additionally, the panel includes a common voltage generating circuit 507 for generating the common voltage VCOM in synchronization with a polarity signal POL. The common voltage generating circuit 507 has the same structure as the common voltage generating circuit 1013 of FIG. 1. Note that the common voltage generating circuit 507 is not disclosed in JP-2001-337657-A.

In FIG. 5, when a selection signal $SEL_1$(="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_1$, $SL_7$, . . . , $SL_{m-5}$, respectively. When a selection signal $SEL_2$(="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_2$, $SL_9$, . . . , $SL_{m-4}$, respectively. When a selection signal $SEL_3$(="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_3$, $SL_9$, . . . , $SL_{m-3}$, respectively. When a selection signal $SEL_4$ (="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_4$, $SL_{10}$, . . . , $SL_{m-2}$, respectively. When a selection signal $SEL_5$(="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_5$, $SL_{11}$, . . . , $SL_{m-1}$, respectively. When a selection signal $SEL_6$(="1") is supplied to the selector circuit 506, the 1-to-6 multiplexers 506-1, 506-2, 506-(m/6) connect the signal lines $SL_1'$, $SL_2'$, . . . , $SL_{m/6}'$ to the signal lines $SL_6$, $SL_{12}$, . . . , $SL_m$, respectively.

Therefore, when the selection signals $SEL_1$, $SEL_2$, $SEL_3$, $SEL_4$, $SEL_5$, and $SEL_6$ are time-divisionally supplied to the selection circuit 506, the selection circuit 506 time-divisionally connects the signal lines $SL_1'$, $SL_2'$, . . . , $SL_{m/6}'$ to the signal lines $SL_1$, $SL_2$, $SL_3$, $SL_4$, $SL_5$, $SL_6$, . . . , $SL_{m-1}$, $SL_m$, so that analog video signals are supplied to the signal lines $SL_1$, $SL_2$, $SL_3$, $SL_4$, $SL_5$, $SL_6$, . . . , $SL_{m-1}$, $SL_m$. Thus, as the substantial number of signal lines connected to the signal line driver is decreased to one sixth, and the number of registers of the horizontal shift register circuit, the number of sampling latch circuits, the number of load latch circuits and the number of D/A converters can be decreased, the signal line driver can be small in size.

Note that, if the time division number of the selector circuit 506 is 9 or 12, the substantial number of signal lines will be further decreased, so that the signal line driver can be further decreased in size.

Here, assume that the same analog video voltage $V_s$ is time-divisionally applied to the pixel units $P_{11}$, $P_{21}$, $P_{31}$, $P_{41}$, $P_{51}$ and $P_{61}$, by the polarity signal POL, and the selection signals $SEL_1$, $SEL_2$, $SEL_3$, $SEL_4$, $SEL_5$ and $SEL_6$ are as shown in FIGS. 6A, 6B, 6C, 6D, 6E, 6F and 6G where a frame and horizontal inversion driving method is carried out. In this case, an electric field of the liquid crystal of the pixel unit $P_{11}$ (R1) is determined by ΔV1 as shown in FIG. 6H. An electric field of the liquid crystal of the pixel unit $P_{21}$ (G1) is determined by ΔV2 (<ΔV1) as shown in FIG. 6H. An electric field of the crystal of the pixel unit $P_{31}$ (B1) is determined by ΔV3 (<ΔV2) as shown in FIG. 6H. An electric field of the liquid crystal of the pixel unit $P_{41}$ (R2) is determined by ΔV4 (<ΔV3) as shown in FIG. 6H. An electric field of the crystal of the pixel unit $P_{51}$ (G2) is determined by ΔV5(<ΔV4) as shown in FIG. 6H. An electric field of the liquid crystal of the pixel unit $P_{61}$ (B2) is determined by ΔV6 (<ΔV5) as shown in FIG. 6H. However, the difference among ΔV1, ΔV2, ΔV3, ΔV4, ΔV5 and ΔV6 cannot be compensated for by the LCD apparatus of FIG. 5.

In order to minimize the above-mentioned difference, as shown in FIGS. 7A, 7B, 7C, 7D, 7E, 7F, 7G and 7H, if the selection signals $SEL_1$, $SEL_2$, . . . , $SEL_6$ are sequentially generated for an N-th frame, the selection signals $SEL_6$, $SEL_5$, . . . , $SEL_1$, may be sequentially generated for an (N+1)-th frame. As a result, an average electric field of the liquid crystal of the pixel unit $P_{11}$ (R1) is (ΔV1+ΔV6)/2, and an average electric field of the liquid crystal of the pixel unit $P_{61}$ (B2) is (ΔV6+ΔV1)/2. Also, an average electric field of the liquid crystal of the pixel unit $P_{21}$ (G1) is (ΔV2+ΔV5)/2, and an average electric field of the liquid crystal of the pixel unit $P_{51}$ (G2) is (ΔV5+ΔV2)/2. Further, an average electric field of the liquid crystal of the pixel unit $P_{31}$ (B1) is (ΔV3+ΔV4)/2, and an average electric field of the liquid crystal of the pixel unit $P_{41}$ (R2) is (ΔV4+ΔV3)/2. Thus, the above-mentioned difference can be compensated for to some extent. However, there is a difference {(ΔV1+ΔV6)−(ΔV4+ΔV3)} between the pixel units $P_{11}$ (R1) and $P_{41}$ (R2) for the red signal R, and there is a difference {(ΔV3+ΔV4)−(ΔV6+ΔV1)} between the pixel units $P_{11}$ (B1) and $P_{41}$ (B2) for the blue signal B, which would cause color errors such as a red error and a blue error, although a green error would not occur.

Also, in the LCD apparatus of FIG. 5, each of the red signal, the green signal and blue signal requires a time division multiplexing which would complicate the control.

Figure 8:
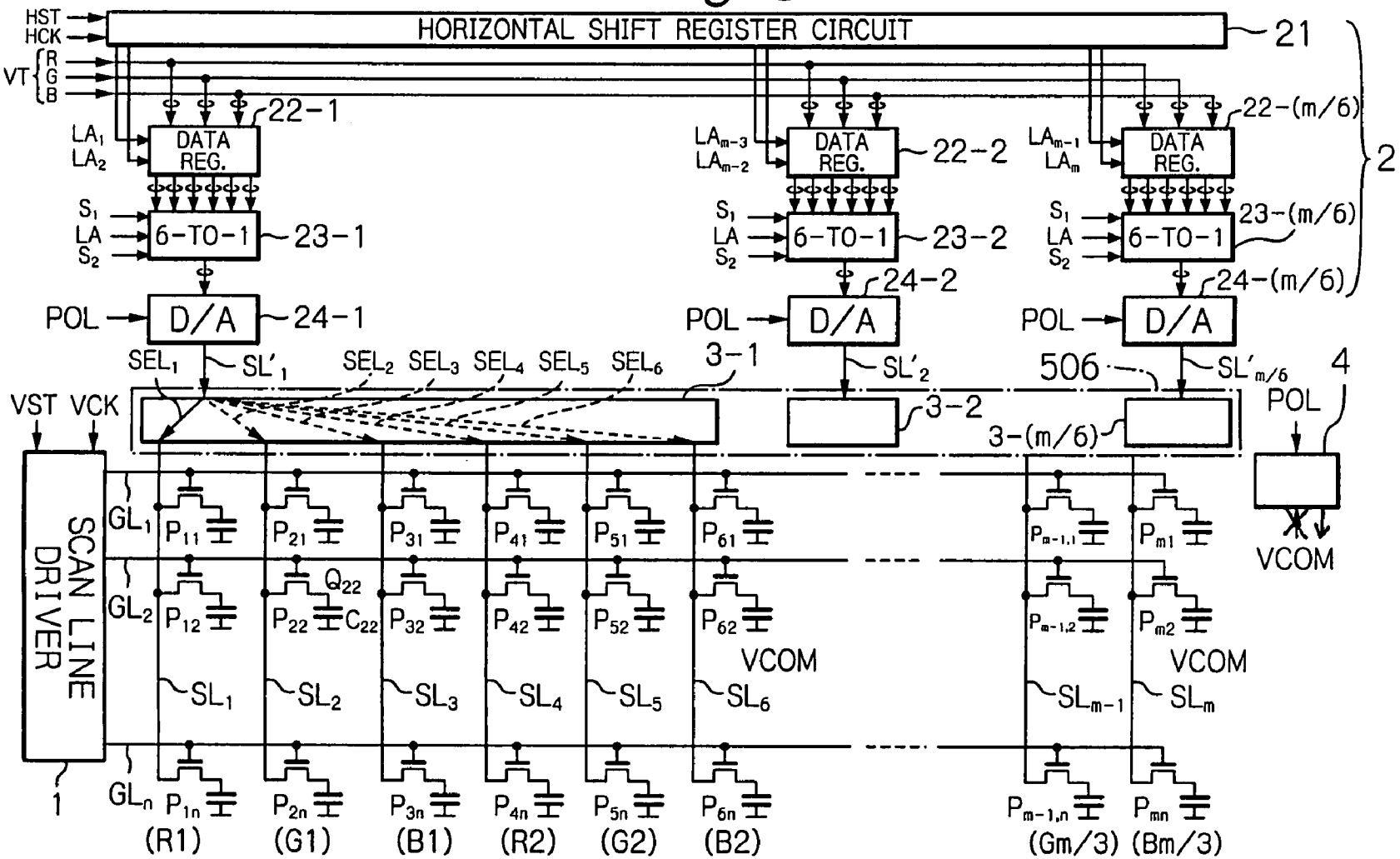
FIG. 8 is a block circuit diagram illustrating an embodiment of the LCD apparatus according to the present invention.

In FIG. 8, which illustrates an embodiment of the LCD apparatus according to the present invention, an m×n-dot panel is constructed by m signal lines $SL_1$, $SL_2$, . . . , $SL_m$, n scan lines $GL_1$, $GL_2$ . . . , $GL_n$, m×n active pixel units $P_{11}$, $P_{12}$, . . . , $P_{mn}$ located at intersections between the signal lines $SL_1$, $SL_2$, . . . , $SL_m$ and the scan lines $GL_1$, $GL_2$, . . . , $GL_n$. Each of the pixel units $P_{11}$, $P_{12}$, . . . , $P_{mn}$ is constructed by one TFT such as $Q_{22}$ and one pixel capacitor such as $C_{22}$ including liquid crystal connected to the TFT $Q_{22}$ and a common electrode to which a common voltage VCOM is applied.

The pixel units $P_{11}$, $P_{12}$, . . . $P_{1n}$ connected to the signal line $SL_1$, the pixel units $P_{41}$, $P_{42}$, . . . , $P_{4n}$ connected to the signal line $SL_4$, . . . are used for displaying red signals R1, R2, . . . . Also, the pixel units $P_{21}$, $P_{22}$, . . . , $P_{2n}$ connected to the signal line $SL_2$, the pixel units $P_{51}$, $P_{52}$, . . . , $P_{5n}$ connected to the signal line $SL_5$, . . . are used for displaying green signals G1, G2, . . . . Further, the pixel units $P_{31}$, $P_{32}$, . . . , $P_{3n}$ connected to the signal line $SL_3$, the pixel units $P_{61}$, $P_{62}$, . . . , $P_{6n}$ connected to the signal line $SL_6$, . . . are used for displaying blue signals B1, B2, . . . .

A scan line driver 1 is constructed by a vertical shift register circuit for shifting a vertical start pulse signal VST in synchronization with a vertical clock signal VCK to sequentially generate scan line signals on the scan lines $GL_1$, $GL_2$, . . . , $GL_n$.

A signal line driver 2 is constructed by a horizontal shift register circuit 21 for shifting a horizontal start pulse signal HST in synchronization with a horizontal clock signal HCK to sequentially generate latch signals $LA_1$, $LA_2$, $LA_3$, $LA_4$, . . . , $LA_{m-1}$, $LA_m$, data registers 22-1, 22-2, . . . , 22-(m/6) for latching a digital gradation video signal VD formed by a red signal R, a green signal G and a blue signal B in synchronization with the latch signals $LA_1$, $LA_2$ . . . , $LA_{m/6}$, respectively, to generate digital video signals $D_1$, $D_2$ . . . , $D_{m/6}$, 6-to-1 multiplexers 23-1, 23-2, . . . , 23-(m/6), and D/A converters 24-1, 24-2, . . . , 24-(m/6) for performing D/A conversions upon the digital video signals of the 6-to-1 multiplexers 23-1, 23-2, . . . , 23-(m/6), respectively, to supply them to signal lines $SL_1'$, $SL_2'$, . . . , $SL_{m/6}'$. Also, in this case, each of the D/A converters 24-1, 24-2, . . . , 24-(m/6) is formed by two D/A conversion units for the positive side and the negative side which are selected in accordance with a polarity signal POL.

The digital video signal VD is sequentially supplied to the data registers 22-1, 22-2, . . . , 22-(m/6); in this case, one time period of the digital video signal VD includes one red signal R, one green signal G and one blue signal B simultaneously, which would simplify the control. Also, each of the data registers 22-1, 22-2, . . . , 22-(m/6) stores two color units each formed by one red signal R, one green signal G and one blue signal B. For example, the data register 22-1 stores a red signal R1, a green signal G1, a blue signal B1, a red signal R2, a green signal G2 and a blue signal B2.

A selector circuit 3 formed by 1-to-6 multiplexers 3-1, 3-2, . . . , 3-(m/6) is connected between the signal lines $SL_1'$, $SL_2'$, . . . , $SL_{m-6}'$ and the signal lines $SL_1$, $SL_2$, $SL_3$, $SL_4$, . . . , $SL_{m-1}$, $SL_m$. The selector circuit 3 has the same structure as the selector circuit 506 of FIG. 5.

Additionally, a common voltage generating circuit 4 for generating the common voltage VCOM in synchronization with a polarity signal POL is provided. The common voltage generating circuit 4 has the same structure as the common voltage generating circuit 1013 of FIG. 1.

Figure 9:
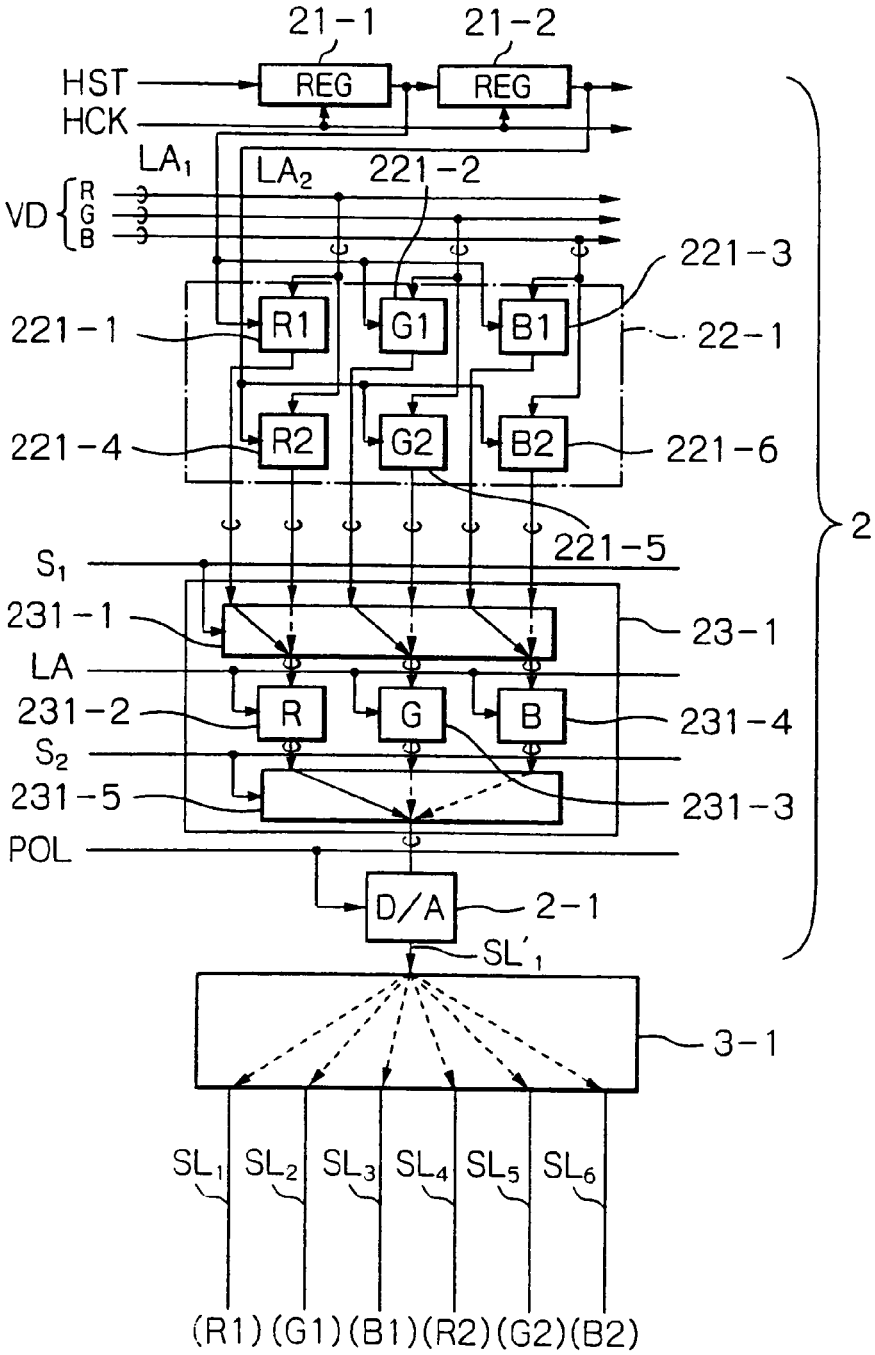
FIG. 9 is a detailed block circuit diagram of a part of the signal line driver of FIG. 8.
Figures 10A, 10B, 10C, 10D, 10E, 10F, 10G, 10H:
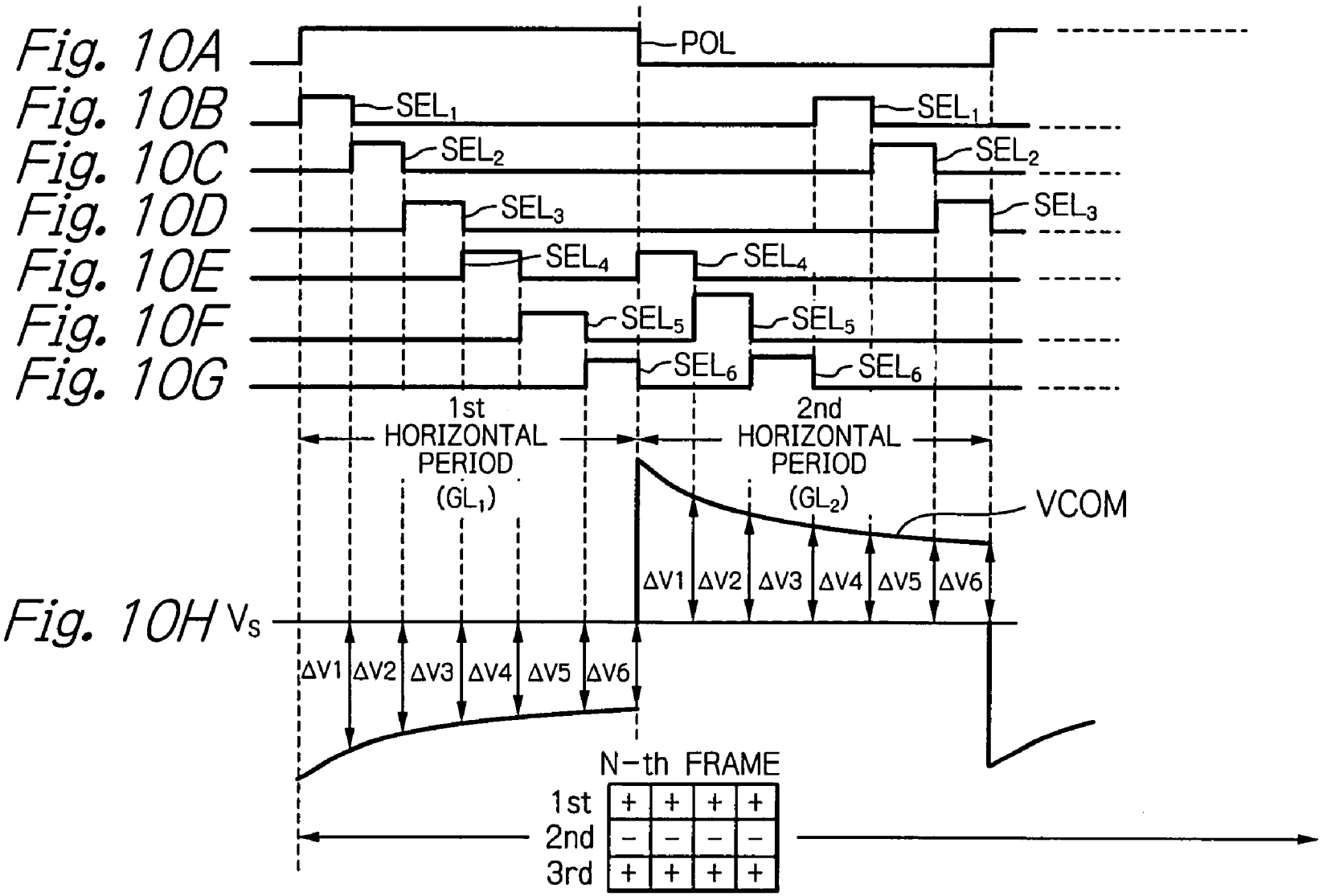
FIGS. 10A through 10H, 11A through 11H, 12A through 12H and 13A through 13H are timing diagrams for explaining a first operation of the LCD apparatus of FIG. 8.
Figures 11A, 11B, 11C, 11D, 11E, 11F, 11G, 11H:
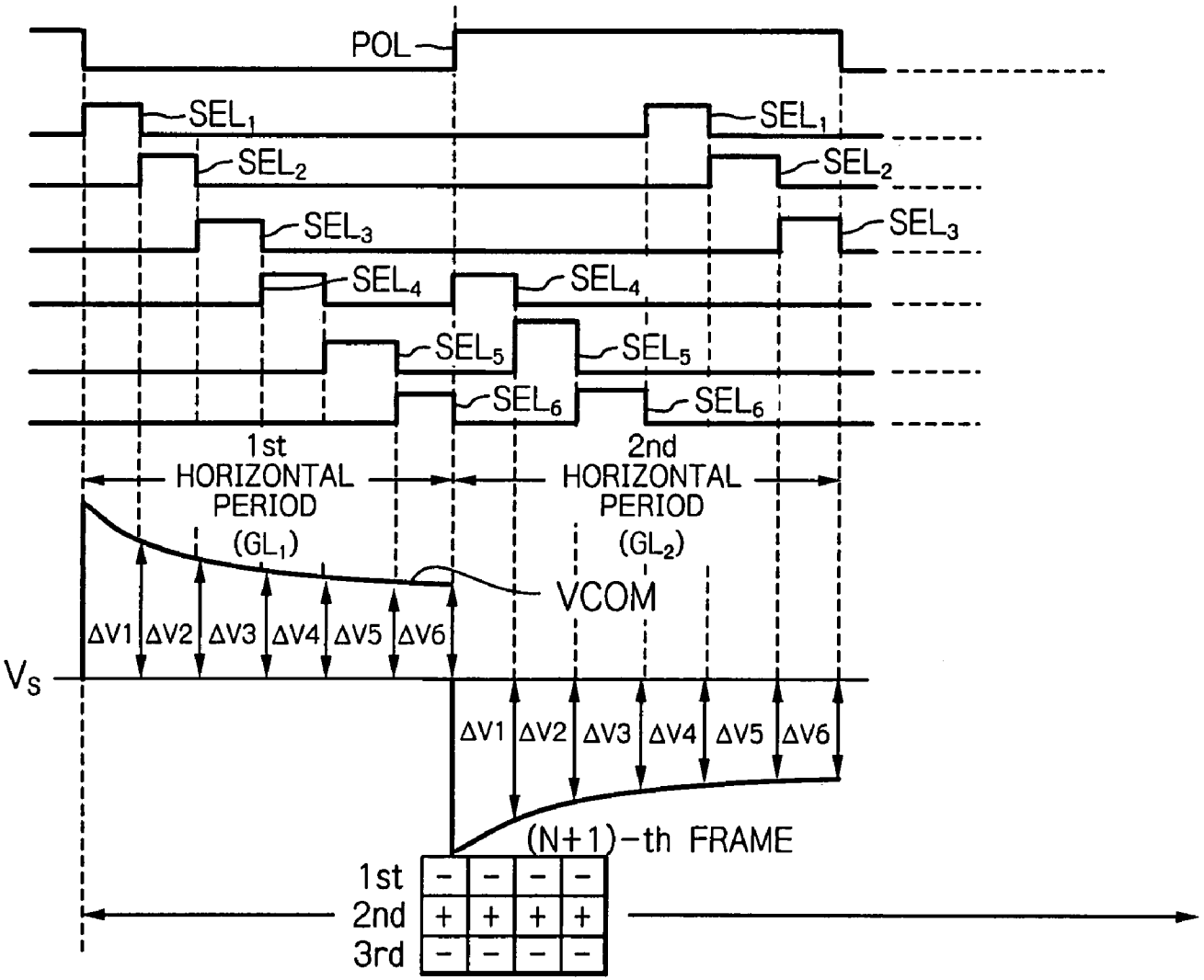
Figures 12A, 12B, 12C, 12D, 12E, 12F, 12G, 12H:
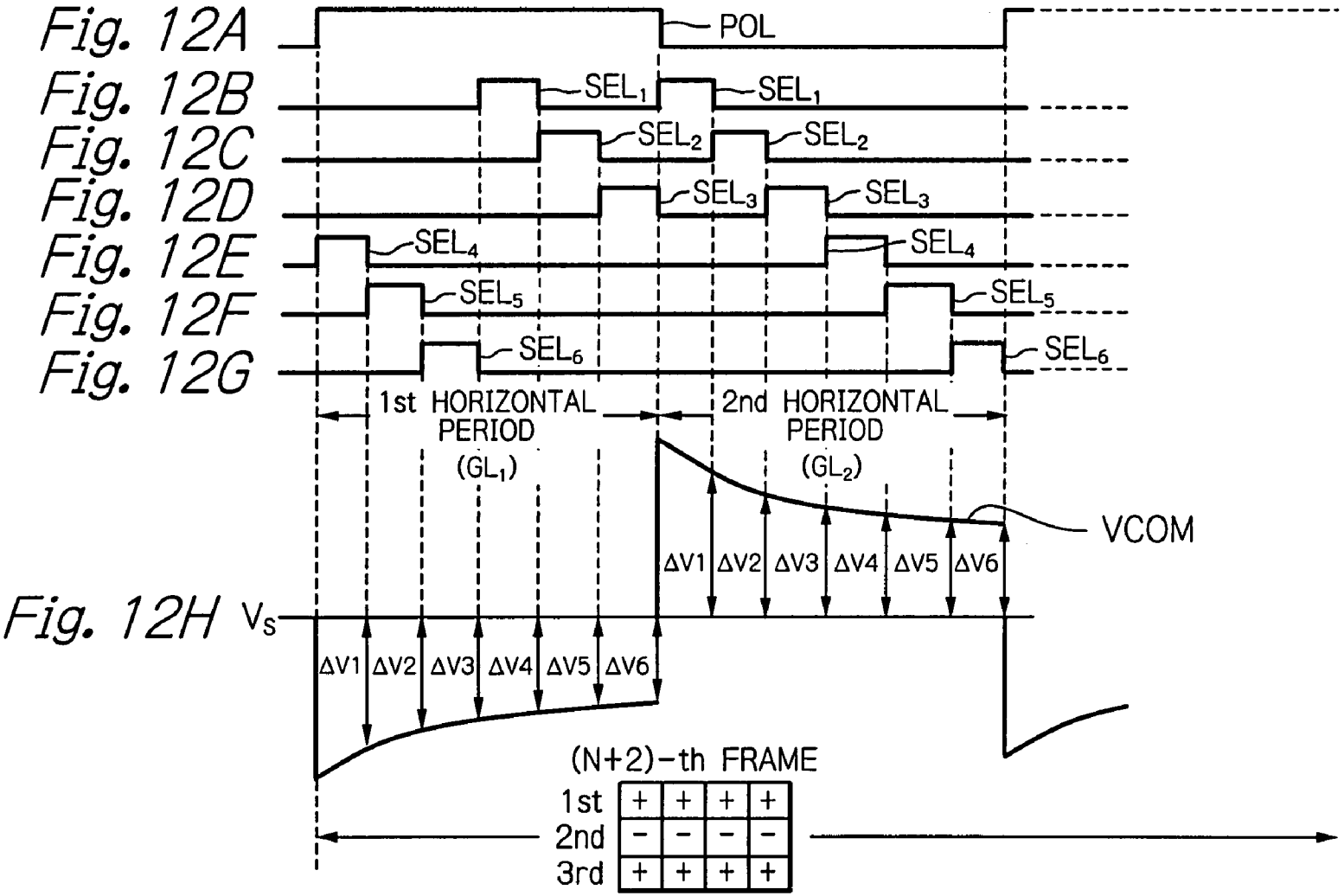
Figures 13A, 13B, 13C, 13D, 13E, 13F, 13G, 13H:
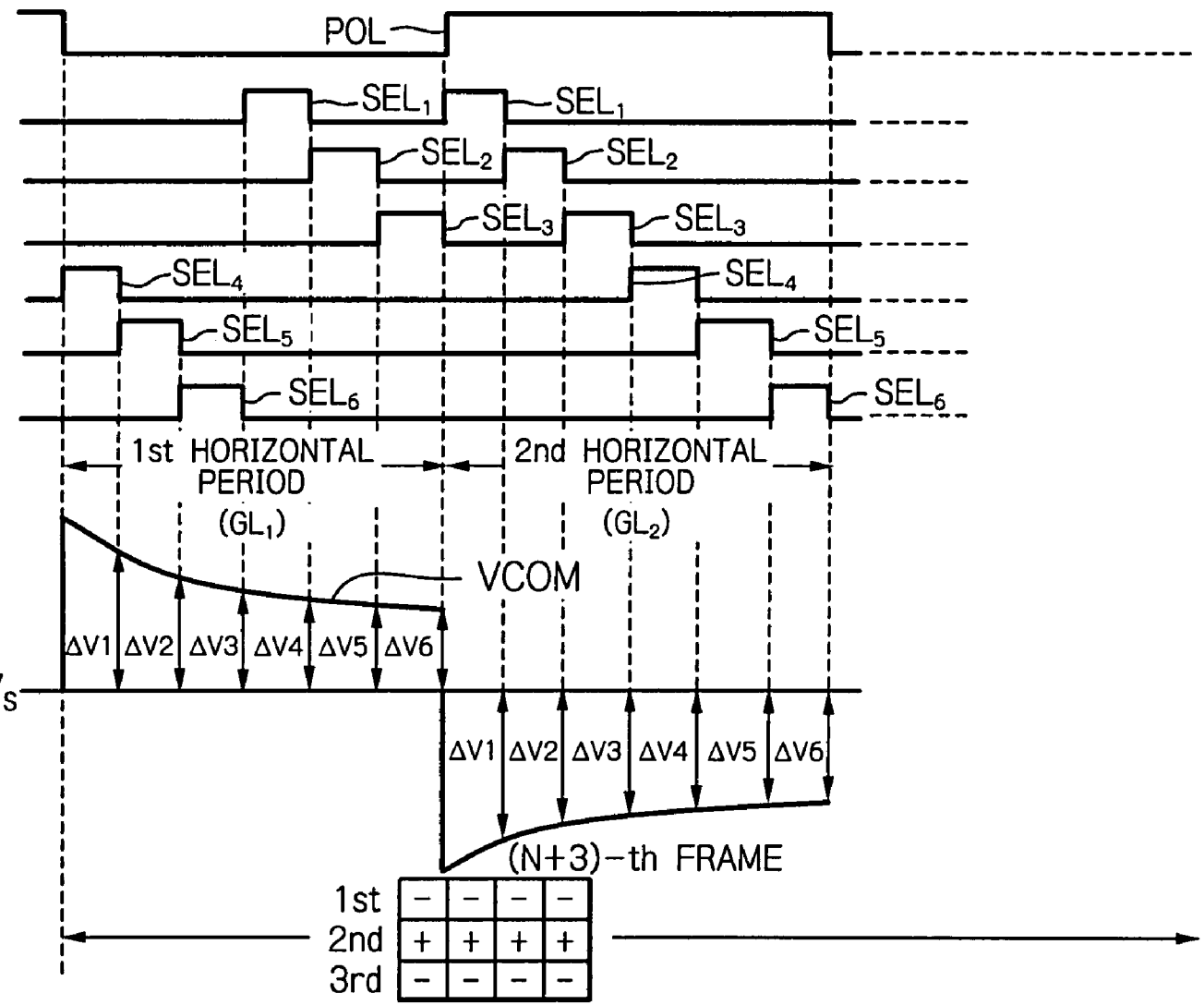
Figures 32A, 32B, 32C, 32D, 32E, 32F, 32G, 32H:
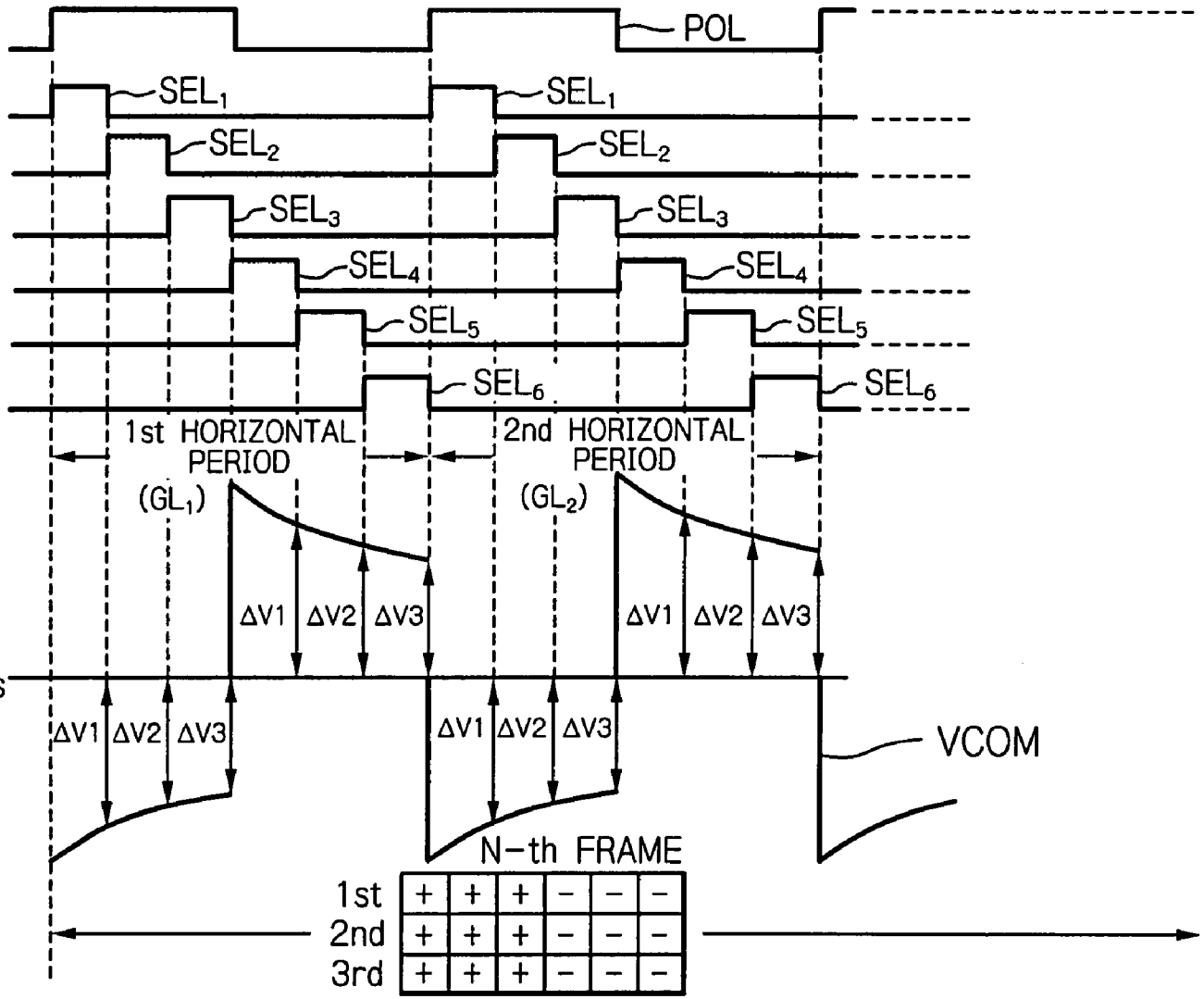
FIGS. 32A through 32H and 33A through 33H are timing diagrams for explaining a second operation of the LCD apparatus of FIG. 8, and FIGS. 34A through 34H and 35A through 35H are timing diagrams for explaining a third operation of the LCD apparatus of FIG. 8.
Figures 33A, 33B, 33C, 33D, 33E, 33F, 33G, 33H:
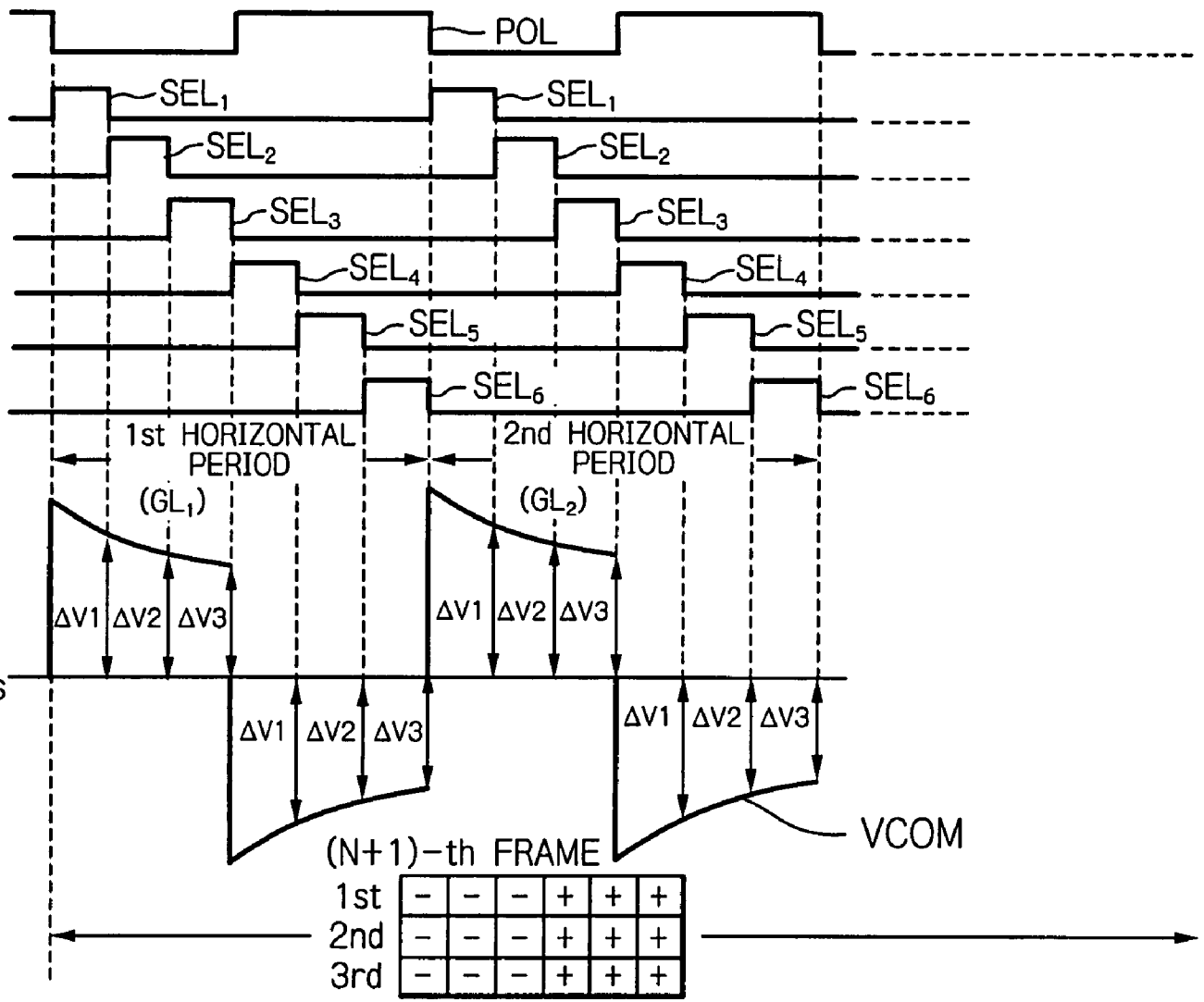
Figures 34A, 34B, 34C, 34D, 34E, 34F, 34G, 34H:
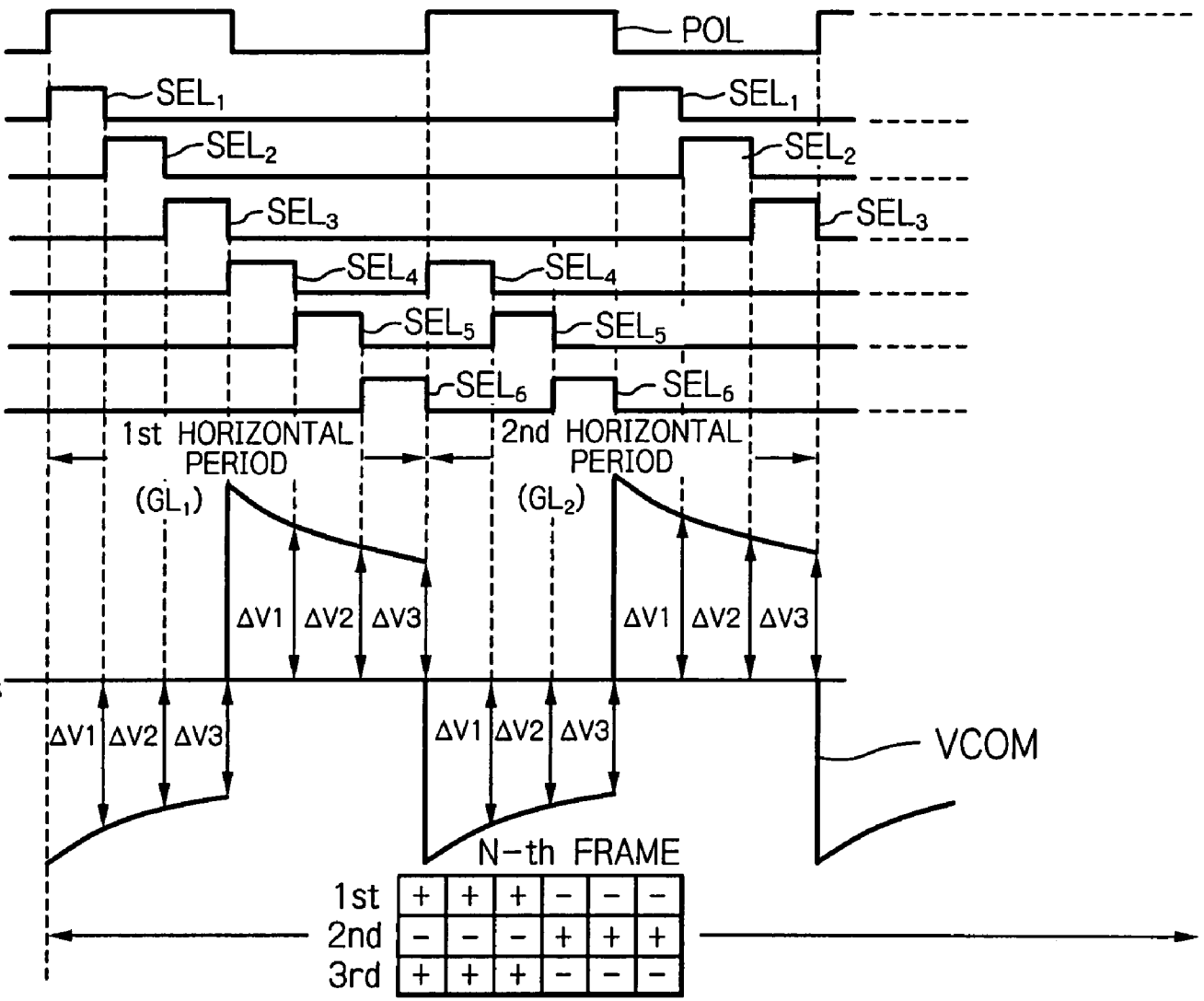
Figures 35A, 35B, 35C, 35D, 35E, 35F, 35G, 35H:
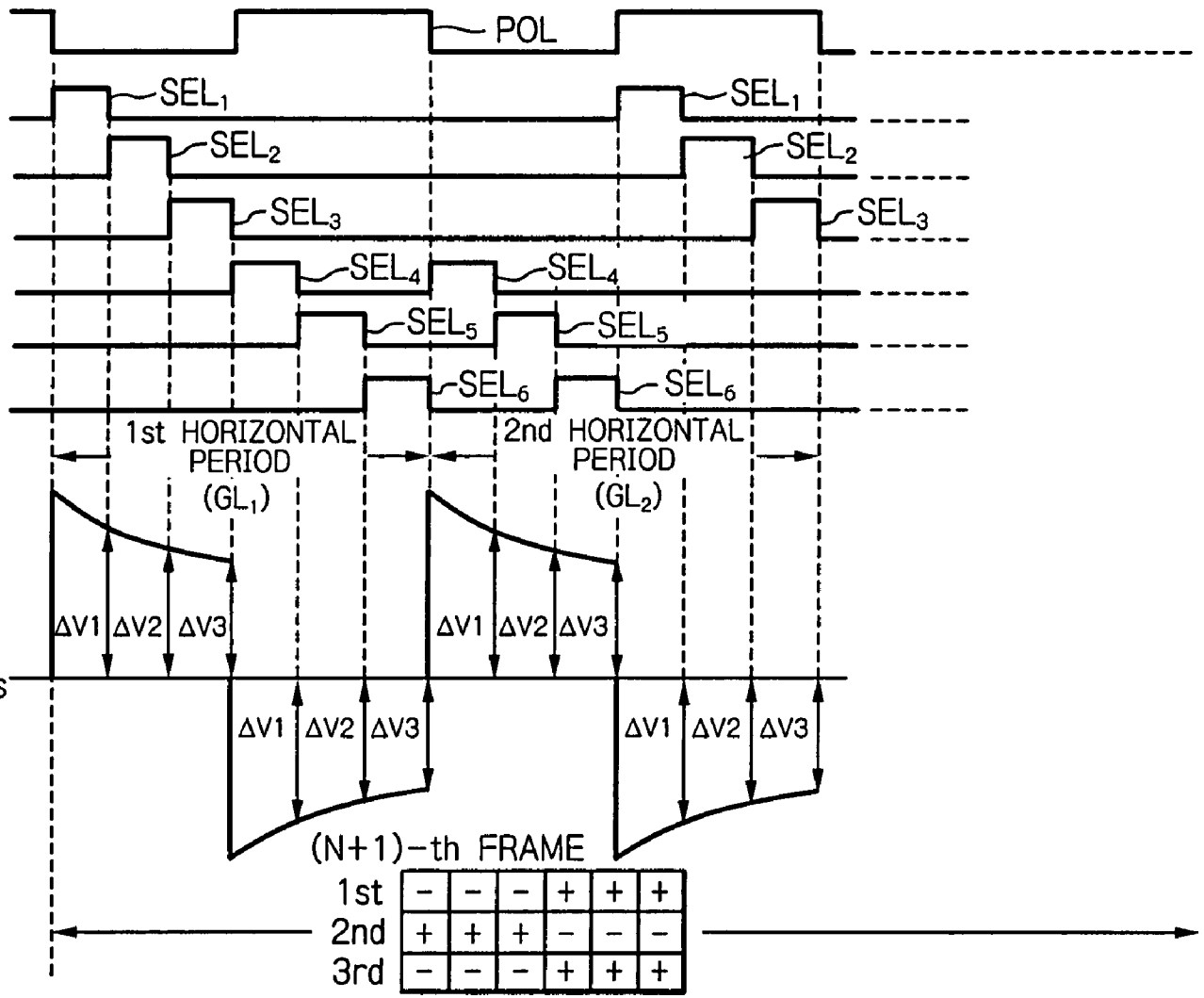

In FIG. 9, which is a detailed block circuit diagram of a part of the signal line driver 2 of for the 1-to-6 multiplexer 3-1 of FIG. 8, the latch signals $LA_1$, and $LA_2$ are generated from shift registers 21-1 and 21-2 of the horizontal shift register circuit 21.

The data register 22-1 is constructed by three latch circuits 221-1, 222-2 and 221-3 for latching the red signal R1, the green signal G1 and the blue signal B1, respectively, in synchronization with the latch signal $LA_1$, and three latch circuits 221-4, 221-5 and 221-6 for latching the red signal R2, the green signal G2 and the blue signal B2, respectively, in synchronization with the latch signal $LA_2$. The red signal R1, the green signal G1, the blue signal B1, the red signal R2, the green signal G2 and the blue signal B2 are supplied to the 6-to-1 multiplexer 23-1.

The 6-to-1 multiplexer 23-1 is constructed by a 6-to-3 multiplexer 231-1 controlled by a selection signal $S_1$, three latch circuits 231-2, 231-3 and 231-4 enabled by a latch signal LA, and a 3-to-1 multiplexer 231-5 controlled by a selection signal $S_2$. The 6-to-1 multiplexer 23-1 selects one of the red signal R1, the green signal G1, the blue signal B1, the red signal R2, the green signal G2 and the blue signal B2 in accordance with the selection signal $S_1$, the latch signal LA and the selection signal $S_2$, and transmits a selected signal to the D/A converter 3-1.

Note that the signals VST, VCK, HST, HCK, VD(R, G, B), $S_1$, LS, $S_2$, POL, $SEL_1$, $SEL_2$, $SEL_3$, $SEL_4$, $SEL_5$ and $SEL_6$ are generated from a controller (not shown). In this case, when the signal line driver 2 generates the red signal R1, the 1-to-6 multiplexer 3-1 selects the signal $SL_1$. When the signal line driver 2 generates the red signal G1, the 1-to-6 multiplexer 3-1 selects the signal $SL_2$. When the signal line driver 2 generates the red signal B1, the 1-to-6 multiplexer 3-1 selects the signal $SL_3$. When the signal line driver 2 generates the red signal R2, the 1-to-6 multiplexer 3-1 selects the signal $SL_4$. When the signal line driver 2 generates the red signal G2, the 1-to-6 multiplexer 3-1 selects the signal $SL_5$. When the signal line driver 2 generates the red signal B2, the 1-to-6 multiplexer 3-1 selects the signal $SL_6$.

A first operation of the LCD apparatus of FIGS. 8 and 9 will be explained next with reference to FIGS. 10A through 10H, 11A through 11H, 12A through 12H and 13A through 13H. Where a frame and horizontal inversion driving method is carried out.

In an N-th frame as shown in FIGS. 10A through 10H, when the scan line $GL_1$ is selected where the polarity signal POL is "1", the selection signals $SEL_1$, $SEL_2$, $SEL_3$, $SEL_4$, $SEL_5$ and $SEL_6$ are sequentially selected at consecutive time slots, so that the signals R1, G1, B1, R2, G2 and B2 are written into the pixel units $P_{11}$, $P_{21}$, $P_{31}$, $P_{41}$, $P_{51}$ and $P_{61}$, respectively, whose liquid crystal the following electric fields are applied to:

$\Delta V1, \Delta V2, \Delta V3, \Delta V4, \Delta V5$ and $\Delta V6$.

Next, when the scan line $GL_2$ is selected where the polarity signal POL is "0", the selection signals $SEL_4$, $SEL_5$, $SEL_6$, $SEL_1$, $SEL_2$ and $SEL_3$ are sequentially selected at consecutive time slots, so that the signals R1, G1, B1, R2, G2 and B2 are written into the pixel units $P_{12}$, $P_{22}$, $P_{32}$, $P_{42}$, $P_{52}$ and $P_{62}$, respectively, whose liquid crystal the following electric fields are applied to:

$\Delta V4, \Delta V5, \Delta V6, \Delta V1, \Delta V2$ and $\Delta V3$.

In an (N+1)-th frame as shown in FIGS. 11A through 11H, when the scan line GL, is selected where the polarity signal POL is "0", the selection signals $SEL_1$, $SEL_2$, $SEL_3$, $SEL_4$, $SEL_5$ and $SEL_6$ are sequentially selected at consecutive time slots, so that the signals R1, G1, B1, R2, G2 and B2 are written into the pixel units $P_{11}$, $P_{21}$, $P_{31}$, $P_{41}$, $P_{51}$, and $P_{61}$, respectively, whose liquid crystal the following electric fields are applied to:

$\Delta V1, \Delta V2, \Delta V3, \Delta V4, \Delta V5$ and $\Delta V6$.

Next, when the scan line $GL_2$ is selected where the polarity signal POL is "1", the selection signals $SEL_4$, $SEL_5$, $SEL_6$, $SEL_1$, $SEL_2$ and $SEL_3$ are sequentially selected at consecutive time slots, so that the signals R1, G1, B1, R2, G2 and B2 are written into the pixel units $P_{11}$, $P_{21}$, $P_{31}$, $P_{41}$, $P_{51}$ and $P_{61}$, respectively, whose liquid crystal the following electric fields are applied to:

$\Delta V4, \Delta V5, \Delta V6, \Delta V1, \Delta V2$and $\Delta V3$.

In an (N+2)-th frame as shown in FIGS. 12A through 12H, when the scan line $GL_1$, is selected where the polarity signal POL is "1", the selection signals $SEL_4$, $SEL_5$, $SEL_6$, $SEL_1$, $SEL_2$ and $SEL_3$ are sequentially selected at consecutive time slots, so that the signals R1, G1, B1, R2, G2 and B2 are written into the pixel units $P_{11}$, $P_{21}$, $P_{31}$, $P_{41}$, $P_{51}$ and $P_{61}$, respectively, whose liquid crystal the following electric fields are applied to:

$\Delta V4, \Delta V5, \Delta V6, \Delta V1, \Delta V2$ and $\Delta V3$.

Next, when the scan line $GL_2$ is selected where the polarity signal POL is "0", the selection signals $SEL_1$, $SEL_2$, $SEL_3$, $SEL_4$, $SEL_5$ and $SEL_6$ are sequentially selected at consecutive time slots, so that the signals R1, G1, B1, R2, G2 and B2 are written into the pixel units $P_{12}$, $P_{22}$, $P_{32}$, $P_{42}$, $P_{52}$ and $P_{62}$, respectively, whose liquid crystal the following electric fields are applied to:

$\Delta V1, \Delta V2, \Delta V3, \Delta V4, \Delta V5$ and $\Delta V6$.

In an (N+3)-th frame as shown in FIGS. 13A through 13H, when the scan line $GL_1$, is selected where the polarity signal POL is "0", the selection signals $SEL_4$, $SEL_5$, $SEL_6$, $SEL_1$, $SEL_2$ and $SEL_3$ are sequentially selected at consecutive time slots, so that the signals R1, G1, B1, R2, G2 and B2 are written into the pixel units $P_{11}$, $P_{21}$, $P_{31}$, $P_{41}$, $P_{51}$ and $P_{61}$, respectively, whose liquid crystal the following electric fields are applied to:

$\Delta V4, \Delta V5, \Delta V6, \Delta V1, \Delta V2$ and $\Delta V3$.

Next, when the scan line $GL_2$ is selected where the polarity signal POL is "1", the selection signals $SEL_1$, $SEL_2$, $SEL_3$, $SEL_4$, $SEL_5$, and $SEL_6$ are sequentially selected at consecutive time slots, so that the signals R1, G1, B1, R2, G2 and B2 are written into the pixel units $P_{12}$, $P_{22}$, $P_{32}$, $P_{42}$, $P_{52}$ and $P_{62}$, respectively, whose liquid crystal the following electric fields are applied to:

$\Delta V1, \Delta V2, \Delta V3, \Delta V4, \Delta V5$ and $\Delta V6$.

As a result, an average electric field of the liquid crystal of each of the pixel units $P_{11}$ (R1) and $P_{41}$ (R2) for the consecutive four frames is $(2\cdot\Delta V1+2\cdot\Delta V4)/4=(\Delta V1+\Delta V4)/2$, thus suppressing the red error. Also, an average electric field of the liquid crystal of each of the pixel units $P_{21}$ (G1) and $P_{51}$ (G2) for the consecutive four frames is $(2\cdot\Delta V2+2\cdot\Delta V5)/4=(\Delta V2+\Delta V5)/2$, thus suppressing the green error. Further, an average electric field of the liquid crystal of each of the pixel units $P_{31}$ (B1) and $P_{61}$ (B2) for the consecutive four frames is $(2\cdot\Delta V3+2\cdot\Delta V6)/4=(\Delta V3+\Delta V6)/2$, thus suppressing the blue error.

In the first operation, since every four frames form one period, no substantial residual DC component exists in the liquid crystal, thus increasing the life-time of the liquid crystal. For example, a residual DC component of the liquid of the pixel unit $P_{11}$ for the consecutive four frames can be represented by $$\Delta V1-\Delta V1+\Delta V4-\Delta V4=0.$$

In the above-mentioned first operation, the driving method for the signal lines $SL_{k+1}$, $SL_{k+2}$, $SL_{k+3}$, $SL_{k+4}$, $SL_{k+5}$ and $SL_{k+6}$ (k=6, 12, . . . , m−6) is the same as the driving method for the signal lines $SL_1$, $SL_2$, $SL_3$, $SL_4$, $SL_5$ and $SL_6$.

Modifications of the first operation are explained next with reference to FIGS. 14A through 14F, FIGS. 15A through 15F, FIGS. 16A through 16F, FIGS. 17A through 17F, FIGS. 18A through 18F, FIGS. 19A through 19F, FIGS. 20A through 20F, FIGS. 21A through 21F, FIGS. 22A through 22F, FIGS. 23A through 23F, FIGS. 24A through 24F, FIGS. 25A through 25F, FIGS. 26A through 26F, FIGS. 27A through 27F, FIGS. 28A through 28F, FIGS. 29A through 29F, FIGS. 30A through 30F, and FIGS. 31A through 31F.

A first modification is shown in FIGS. 14A through 14F and FIGS. 15A through 15F. That is, in N-th and (N+1)-th frames as shown in FIGS. 14A through 14F, the pixel units $P_{11}$, $P_{21}$, $P_{31}$, $P_{41}$, $P_{51}$ and $P_{61}$, respectively, have liquid crystal which the following electric fields are applied:

ΔV1, ΔV3, ΔV5, ΔV2, ΔV4 and ΔV6, and the pixel units $P_{12}$, $P_{22}$, $P_{32}$, $P_{42}$, $P_{52}$ and $P_{62}$, respectively, have liquid crystal which the following electric fields are applied to:

ΔV2, ΔV4, ΔV6, ΔV1, ΔV3 and ΔV5.

Also, in (N+2)-th and (N+3)-th frames as shown in FIGS. 14A through 14F, the pixel units $P_{11}$, $P_{21}$, $P_{31}$, $P_{41}$, $P_{51}$ and $P_{61}$, respectively, have liquid crystal which the following electric fields are applied to:

ΔV2, ΔV4, ΔV6, ΔV1, ΔV3 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV3, ΔV5, ΔV2, ΔV4 and ΔV6.

As a result, an average electric field of the liquid crystal of each of the pixel units $P_{11}$, (R1) and $P_{41}$ (R2) for the consecutive four frames is (2·ΔV1+2·ΔV2)/4=(ΔV1+ΔV2)/2, thus suppressing the red error. Also, an average electric field of the liquid crystal of each of the pixel units $P_{21}$ (G1) and $P_{51}$ (G2) for the consecutive four frames is (2·ΔV3+2·ΔV4)/4=(ΔV3+ΔV4)/2, thus suppressing the green error. Further, an average electric field of the liquid crystal of each of the pixel units $P_{31}$ (B1) and $P_{61}$ (B2) for the consecutive four frames is (2·ΔV5+2·ΔV6)/4=(ΔV5+ΔV6)/2, thus suppressing the blue error.

Even in the first modification, there is no substantial residual DC component in the liquid crystal. For example, a residual DC component of the pixel unit $P_{11}$ for the consecutive four frames can be represented by $$\Delta V1-\Delta V1+\Delta V2-\Delta V2=0$$

A second modification is shown in FIGS. 16A through 16F and FIGS. 17A through 17F. That is, in N-th and (N+1)-th frames as shown in FIGS. 16A through 16F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV3, ΔV4, ΔV2, ΔV6 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV2, ΔV6, ΔV5, ΔV1, ΔV3 and ΔV4.

Also, in (N+2)-th and (N+3)-th frames as shown in FIGS. 17A through 17F, the pixel units $P_{11}$, $P_{21}$, $P_{31}$, $P_{41}$, $P_{51}$ and $P_{61}$, respectively, have liquid crystal which the following electric fields are applied to:

ΔV2, ΔV6, ΔV5, ΔV1, ΔV3 and ΔV4, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV3, ΔV4, ΔV2, ΔV6 and ΔV5.

As a result, an average electric field of the liquid crystal of each of the pixel units $P_{11}$ (R1) and $P_{41}$ (R2) for the consecutive four frames is (2·ΔV1+2·ΔV2)/4=(ΔV1+ΔV2)/2, thus suppressing the red error. Also, an average electric field of the liquid crystal of each of the pixel units $P_{21}$, (G1) and $P_{51}$ (G2) for the consecutive four frames is (2·ΔV3+2·ΔV6)/4=(ΔV3+ΔV6)/2, thus suppressing the green error. Further, an average electric field of the liquid crystal of each of the pixel units $P_{31}$ (B1) and $P_{61}$, (B2) for the consecutive four frames is (2·ΔV4+2·ΔV5)/4=(ΔV4+ΔV5)/2, thus suppressing the blue error.

Even in the second modification, there is no substantial residual DC component in the liquid crystal. For example, a residual DC component of the pixel unit $P_{11}$ for the consecutive four frames can be represented by $$\Delta V1-\Delta V1+\Delta V2-\Delta V2=0$$

A third modification is shown in FIGS. 18A through 18F and FIGS. 19A through 19F. That is, in N-th and (N+1)-th frames as shown in FIGS. 18A through 18F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV5, ΔV3, ΔV4 and ΔV6, and the pixel units $P_{12}$, $P_{22}$, $P_{32}$, $P_{42}$, $P_{52}$ and $P_{62}$, respectively, have liquid crystal which the following electric fields are applied to:

ΔV3, ΔV4, ΔV6, ΔV1, ΔV2 and ΔV5.

Also, in (N+2)-th and (N+3)-th frames as shown in FIGS. 19A through 19F, the pixel units $P_{11}$, $P_{21}$, $P_{31}$, $P_{41}$, $P_{51}$ and $P_{61}$, respectively, have liquid crystal which the following electric fields are applied to:

ΔV3, ΔV4, ΔV6, ΔV1, ΔV2 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV5, ΔV3, ΔV4 and ΔV6.

As a result, an average electric field of the liquid crystal of each of the pixel units $P_{11}$ (R1) and $P_{41}$ (R2) for the consecutive four frames is (2·ΔV1+2·ΔV3)/4=(ΔV1+ΔV3)/2, thus suppressing the red error. Also, an average electric field of the liquid crystal of each of the pixel units $P_{21}$ (G1) and $P_{51}$ (G2) for the consecutive four frames is (2·ΔV2+2·ΔV4)/4=(ΔV2+ΔV4)/2, thus suppressing the green error. Further, an average electric field of the liquid crystal of each of the pixel units $P_{31}$ (B1) and $P_{61}$ (B2) for the consecutive four frames is (2·ΔV5+2·ΔV6)/4=(ΔV5+ΔV6)/2, thus suppressing the blue error.

Even in the third modification, there is no substantial residual DC component in the liquid crystal. For example, a residual DC component of the pixel unit $P_{11}$ for the consecutive four frames can be represented by $$\Delta V1-\Delta V1+\Delta V3-\Delta V3=0$$

A fourth modification is shown in FIGS. 20A through 20F and FIGS. 21A through 21F. That is, in N-th and (N+1)-th frames as shown in FIGS. 20A through 20F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV4, ΔV3, ΔV6 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV3, ΔV6, ΔV5, ΔV1, ΔV2 and ΔV4.

Also, in (N+2)-th and (N+3)-th frames as shown in FIGS. 21A through 21F, the pixel units $P_{11}$, $P_{21}$, $P_{31}$, $P_{41}$, $P_{51}$ and $P_{61}$, respectively, have liquid crystal which the following electric fields are applied to:

ΔV3, ΔV6, ΔV5, ΔV1, ΔV2 and ΔV4, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV4, ΔV3, ΔV6 and ΔV5.

As a result, an average electric field of the liquid crystal of each of the pixel units $P_{11}$, (R1) and $P_{41}$ (R2) for the consecutive four frames is (2·ΔV1+2·ΔV3)/4=(ΔV1+ΔV3)/2, thus suppressing the red error. Also, an average electric field of the liquid crystal of each of the pixel units $P_{21}$ (G1) and $P_{51}$ (G2) for the consecutive four frames is (2·ΔV2+2·ΔV6)/4=(ΔV2+ΔV6)/2, thus suppressing the green error. Further, an average electric field of the liquid crystal of each of the pixel units $P_{31}$ (B1) and $P_{61}$ (B2) for the consecutive four frames is (2·ΔV4+2·ΔV5)/4=(ΔV4+ΔV5)/2, thus suppressing the blue error.

Even in the fourth modification, there is no substantial residual DC component in the liquid crystal. For example, a residual DC component of the pixel unit $P_{11}$, for the consecutive four frames can be represented by $$\Delta V1-\Delta V1+\Delta V3-\Delta V3=0$$

A fifth modification is shown in FIGS. 22A through 22F and FIGS. 23A through 23F. That is, in N-th and (N+1)-th frames as shown in FIGS. 22A through 22F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV3, ΔV4, ΔV6 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV4, ΔV6, ΔV5, ΔV1, ΔV2 and ΔV3.

Also, in (N+2)-th and (N+3)-th frames as shown in FIGS. 23A through 23F, the pixel units $P_{11}$, $P_{21}$, $P_{31}$, $P_{41}$, $P_{51}$ and $P_{61}$, respectively, have liquid crystal which the following electric fields are applied to:

ΔV4, ΔV6, ΔV5, ΔV1, ΔV2 and ΔV3, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV3, ΔV4, ΔV6 and ΔV5.

As a result, an average electric field of the liquid crystal of each of the pixel units $P_{11}$ (R1) and $P_{41}$ (R2) for the consecutive four frames is (2·ΔV1+2·ΔV4)/4=(ΔV1+ΔV4)/2, thus suppressing the red error. Also, an average electric field of the liquid crystal of each of the pixel units $P_{21}$ (G1) and $P_{51}$ (G2) for the consecutive four frames is (2·ΔV2+2·ΔV6)/4=(ΔV2+ΔV6)/2, thus suppressing the green error. Further, an average electric field of the liquid crystal of each of the pixel units $P_{31}$ (B1) and $P_{61}$ (B2) for the consecutive four frames is (2·ΔV3+2·ΔV5)/4=(ΔV3+ΔV5)/2, thus suppressing the blue error.

Even in the fifth modification, there is no substantial residual DC component in the liquid crystal. For example, a residual DC component of the pixel unit $P_{11}$ for the consecutive four frames can be represented by $$\Delta V1-\Delta V1+\Delta V4-\Delta V4=0$$

A sixth modification is shown in FIGS. 24A through 24F and FIGS. 25A through 25F. That is, in N-th and (N+1)-th frames as shown in FIGS. 24A through 24F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV3, ΔV5, ΔV6 and ΔV4, and the pixel units $P_{12}$, $P_{22}$, $P_{32}$, $P_{42}$, $P_{52}$ and $P_{62}$, respectively, have liquid crystal which the following electric fields are applied to:

ΔV5, ΔV6, ΔV4, ΔV1, ΔV2 and ΔV3.

Also, in (N+2)-th and (N+3)-th frames as shown in FIGS. 25A through 25F, the pixel units $P_{11}$, $P_{21}$, $P_{31}$, $P_{41}$, $P_{51}$ and $P_{61}$, respectively, have liquid crystal which the following electric fields are applied to:

ΔV5, ΔV6, ΔV4, ΔV1, ΔV2 and ΔV3, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV3, ΔV5, ΔV6 and ΔV4.

As a result, an average electric field of the liquid crystal of each of the pixel units $P_{11}$ (R1) and $P_{41}$ (R2) for the consecutive four frames is (2·ΔV1+2·ΔV5)/4=(ΔV1+ΔV5)/2, thus suppressing the red error. Also, an average electric field of the liquid crystal of each of the pixel units $P_{21}$ (G1) and $P_{51}$ (G2) for the consecutive four frames is (2·ΔV2+2·ΔV6)/4=(ΔV2+ΔV6)/2, thus suppressing the green error. Further, an average electric field of the liquid crystal of each of the pixel units $P_{31}$ (B1) and $P_{61}$ (B2) for the consecutive four frames is (2·ΔV3+2·ΔV4)/4=(ΔV3+ΔV4)/2, thus suppressing the blue error.

Even in the sixth modification, there is no substantial residual DC component in the liquid crystal. For example, a residual DC component of the pixel unit $P_{11}$ for the consecutive four frames can be represented by $$\Delta V1-\Delta V1+\Delta V5-\Delta V5=0$$

A seventh modification is shown in FIGS. 26A through 26F and FIGS. 27A through 27F. That is, in N-th and (N+1)-th frames as shown in FIGS. 26A through 26F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV3, ΔV5, ΔV4 and ΔV6, and the pixel units $P_{12}$, $P_{22}$, $P_{32}$, $P_{42}$, $P_{52}$ and $P_{62}$, respectively, have liquid crystal which the following electric fields are applied to:

ΔV5, ΔV4, ΔV6, ΔV1, ΔV2 and ΔV3.

Also, in (N+2)-th and (N+3)-th frames as shown in FIGS. 27A through 27F, the pixel units $P_{11}$, $P_{21}$, $P_{31}$, $P_{41}$, $P_{51}$ and $P_{61}$, respectively, have liquid crystal which the following electric fields are applied to:

ΔV5, ΔV4, ΔV6, ΔV1, ΔV2 and ΔV3, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV3, ΔV5, ΔV4 and ΔV6.

As a result, an average electric field of the liquid crystal of each of the pixel units $P_{11}$ (R1) and $P_{41}$ (R2) for the consecutive four frames is (2·ΔV1+2·ΔV5)/4=(ΔV1+ΔV5)/2, thus suppressing the red error. Also, an average electric field of the liquid crystal of each of the pixel units $P_{21}$ (G1) and $P_{51}$ (G2) for the consecutive four frames is $(2\cdot\Delta V2+2\cdot\Delta V4)/4=(\Delta V2+\Delta V4)/2$, thus suppressing the green error. Further, an average electric field of the liquid crystal of each of the pixel units $P_{31}$ (B1) and $P_{61}$ (B2) for the consecutive four frames is $(2\cdot\Delta V3+2\cdot\Delta V6)/4=(\Delta V3+\Delta V6)/2$, thus suppressing the blue error.

Even in the seventh modification, there is no substantial residual DC component in the liquid crystal. For example, a residual DC component of the pixel unit $P_{11}$ for the consecutive four frames can be represented by $$\Delta V1-\Delta V1+\Delta V5-\Delta V5=0$$

An eighth modification is shown in FIGS. 28A through 28F and FIGS. 29A through 29F. That is, in N-th and (N+1)-th frames as shown in FIGS. 28A through 28F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV3, ΔV6, ΔV5 and ΔV4, and the pixel units $P_{12}$, $P_{22}$, $P_{32}$, $P_{42}$, $P_{52}$ and $P_{62}$, respectively, have liquid crystal which the following electric fields are applied to:

ΔV6, ΔV5, ΔV4, ΔV1, ΔV2 and ΔV3.

Also, in (N+2)-th and (N+3)-th frames as shown in FIGS. 29A through 29F, the pixel units $P_{11}$, $P_{21}$, $P_{31}$, $P_{41}$, $P_{51}$ and $P_{61}$, respectively, have liquid crystal which the following electric fields are applied to:

ΔV6, ΔV5, ΔV4, ΔV1, ΔV2 and ΔV3, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV3, ΔV6, ΔV5 and ΔV4.

As a result, an average electric field of the liquid crystal of each of the pixel units $P_{11}$ (R1) and $P_{41}$ (R2) for the consecutive four frames is $(2\cdot\Delta V1+2\cdot\Delta V6)/4=(\Delta V1+\Delta V6)/2$, thus suppressing the red error. Also, an average electric field of the liquid crystal of each of the pixel units $P_{21}$ (G1) and $P_{51}$ (G2) for the consecutive four frames is $(2\cdot\Delta V2+2\cdot\Delta V5)/4=(\Delta V2+\Delta V5)/2$, thus suppressing the green error. Further, an average electric field of the liquid crystal of each of the pixel units $P_{31}$ (B1) and $P_{61}$ (B2) for the consecutive four frames is $(2\cdot\Delta V3+2\cdot\Delta V4)/4=(\Delta V3+\Delta V4)/2$, thus suppressing the blue error.

Even in the eighth modification, there is no substantial residual DC component in the liquid crystal. For example, a residual DC component of the pixel unit $P_{11}$, for the consecutive four frames can be represented by $$\Delta V1-\Delta V1+\Delta V6-\Delta V6=0$$

A ninth modification is shown in FIGS. 30A through 30F and FIGS. 31A through 31F. That is, in N-th and (N+1)-th frames as shown in FIGS. 30A through 30F, the pixel units $P_{11}$, $P_{21}$, $P_{31}$, $P_{41}$, $P_{51}$ and $P_{61}$, respectively, have liquid crystal which the following electric fields are applied to:

ΔV1, ΔV2, ΔV3, ΔV6, ΔV4 and ΔV5, and the pixel units $P_{12}$, $P_{22}$, $P_{32}$, $P_{42}$, $P_{52}$ and $P_{62}$, respectively, have liquid crystal which the following electric fields are applied to:

ΔV6, ΔV4, ΔV3, ΔV1, ΔV2 and ΔV3.

Also, in (N+2)-th and (N+3)-th frames as shown in FIGS. 31A through 31F, the pixel units $P_{11}$, $P_{21}$, $P_{31}$, $P_{41}$, $P_{51}$ and $P_{61}$, respectively, have liquid crystal which the following electric fields are applied to:

ΔV6, ΔV4, ΔV3, ΔV1, ΔV2 and ΔV3, and the pixel units $P_{12}$, $P_{22}$, $P_{32}$, $P_{42}$, $P_{52}$ and $P_{62}$, respectively, have liquid crystal which the following electric fields are applied to:

ΔV1, ΔV2, ΔV3, ΔV6, ΔV4 and ΔV5.

As a result, an average electric field of the liquid crystal of each of the pixel units $P_{11}$ (R1) and $P_{41}$ (R2) for the consecutive four frames is $(2\cdot\Delta V1+2\cdot\Delta V6)/4=(\Delta V1+\Delta V6)/2$, thus suppressing the red error. Also, an average electric field of the liquid crystal of each of the pixel units $P_{21}$ (G1) and $P_{51}$ (G2) for the consecutive four frames is $(2\cdot\Delta V2+2\cdot\Delta V4)/4=(\Delta V2+\Delta V4)/2$, thus suppressing the green error. Further, an average electric field of the liquid crystal of each of the pixel units $P_{31}$ (B1) and $P_{61}$ (B2) for the consecutive four frames is $(2\cdot\Delta V3+2\cdot\Delta V5)/4=(\Delta V3+\Delta V5)/2$, thus suppressing the blue error.

Even in the ninth modification, there is no substantial residual DC component in the liquid crystal. For example, a residual DC component of the pixel unit $P_{11}$ for the consecutive four frames can be represented by $$\Delta V1-\Delta V1+\Delta V6-\Delta V6=0$$

A second operation of the LCD apparatus of FIGS. 8 and 9 will be explained next with reference to FIGS. 32A through 32H and 33A through 33H, where a frame and vertical inversion driving method is carried out.

In an N-th frame as shown in FIGS. 32A through 32H, when the scan line $GL_1$ is selected where the polarity signal POL is "1", the selection signals $SEL_1$, $SEL_2$ and $SEL_3$ are sequentially selected at consecutive time slots, so that the signals R1, G1 and B1 are written into the pixel units $P_{11}$, $P_{21}$ and $P_{31}$, respectively, whose liquid crystal the following electric fields are applied to:

ΔV1, ΔV2 and ΔV3.

Then, the polarity signal POL is switched from "1" to "0" while the scan line $GL_1$ (="1") is maintained, the selection signals $SEL_4$, $SEL_5$ and $SEL_6$ are sequentially selected at consecutive time slots, so that the signals R2, G2 and B2 are written into the pixel units $P_{41}$, $P_{51}$ and $P_{61}$, respectively, whose liquid crystal the following electric fields are applied to:

ΔV1, ΔV2 and ΔV3.

Next, when the scan line $GL_2$ is selected where the polarity signal POL is "1", the selection signals $SEL_1$, $SEL_2$ and $SEL_3$ are sequentially selected at consecutive time slots, so that the signals R1, G1 and B1 are written into the pixel units $P_{12}$, $P_{22}$ and $P_{32}$, respectively, whose liquid crystal the following electric fields are applied to:

ΔV1, ΔV2 and ΔV3.

Then, the polarity signal POL is switched from "1" to "0" while the scan line $GL_2$(="1") is maintained, the selection signals $SEL_4$, $SEL_5$ and $SEL_6$ are sequentially selected, so that the signals R2, G2 and B2 are written into the pixel units $P_{42}$, $P_{52}$ and $P_{62}$, respectively, whose liquid crystal the following electric fields are applied to:

ΔV1, ΔV2 and ΔV3.

In an (N+1) frame as shown in FIGS. 33A through 33H, when the scan line $GL_1$ is selected where the polarity signal POL is "0", the selection signals $SEL_1$, $SEL_2$ and $SEL_3$ are sequentially selected at consecutive time slots, so that the signals R1, G1 and B1 are written into the pixel units $P_{11}$, $P_{21}$ and $P_{31}$, respectively, whose liquid crystal the following electric fields are applied to:

ΔV1, ΔV2 and ΔV3.

Then, the polarity signal POL is switched from "0" to "1" while the scan line $GL_1$ (="1") is maintained, the selection signals $SEL_4$, $SEL_5$ and $SEL_6$ are sequentially selected at consecutive time slots, so that the signals R2, G2 and B2 are written into the pixel units $P_{41}$, $P_{51}$, and $P_{61}$, respectively, whose liquid crystal the following electric fields are applied to:

ΔV1, ΔV2 and ΔV3.

Next, when the scan line $GL_2$ is selected where the polarity signal POL is "0", the selection signals $SEL_1$, $SEL_2$ and $SEL_3$ are sequentially selected at consecutive time slots, so that the signals R1, G1 and B1 are written into the pixel units $P_{12}$, $P_{22}$ and $P_{32}$, respectively, whose liquid crystal the following electric fields are applied to:

ΔV1, ΔV2 and ΔV3.

Then, the polarity signal POL is switched from "0" to "1" while the scan line $GL_2$ (="1") is maintained, the selection signals $SEL_4$, $SEL_5$ and $SEL_6$ are sequentially selected at consecutive time slots, so that the signals R2, G2 and B2 are written into the pixel units $P_{42}$, $P_{52}$ and $P_{62}$, respectively, whose liquid crystal the following electric fields are applied to:

ΔV1, ΔV2 and ΔV3.

As a result, an average electric field of the liquid crystal of each of the pixel units $P_{11}$ (R1) and $P_{41}$ (R2) for the consecutive two frames is (2·ΔV1)/2=ΔV1, thus suppressing the red error. Also, an average electric field of the liquid crystal of each of the pixel units $P_{21}$ (G1) and $P_{51}$ (G2) for the four frames is 2·ΔV2/2=ΔV2, thus suppressing the green error. Further, an average electric field of the liquid crystal of each of the pixel units $P_{31}$ (B1) and $P_{61}$ (B2) for the four frames is 2·ΔV3/2=ΔV3, thus suppressing the blue error.

In the second operation, since every two frames form one period, no substantial residual DC component exists in the liquid crystal, thus increasing the life-time of the liquid crystal. For example, a residual DC component of the liquid of the pixel unit $P_{11}$ for the consecutive two frames can be represented by $$\Delta V1-\Delta V1=0$$

In the above-mentioned second operation, the driving method for the signal lines $SL_{k+1}$, $SL_{k+2}$, $SL_{k+3}$, $SL_{k+4}$, $SL_{k+5}$ and $SL_{k+6}$ (k=6, 12, . . . , m−6) is the same as the driving method for the signal lines $SL_1$, $SL_2$, $SL_3$, $SL_4$, $SL_5$ and $SL_6$.

A third operation of the LCD apparatus of FIGS. 8 and 9 will be explained next with reference to FIGS. 34A through 34H and 35A through 35H, where a frame and dot inversion driving method is carried out.

In an N-th frame as shown in FIGS. 34A through 34H, when the scan line $GL_1$, is selected where the polarity signal POL is "1", the selection signals $SEL_1$, $SEL_2$ and $SEL_3$ are sequentially selected at consecutive time slots, so that the signals R1, G1 and B1 are written into the pixel units $P_{11}$, $P_{21}$ and $P_{31}$, respectively, whose liquid crystal the following electric fields are applied to:

ΔV1, ΔV2 and ΔV3.

Then, the polarity signal POL is switched from "1" to "0" while the scan line $GL_1$ (="1") is maintained, the selection signals $SEL_4$, $SEL_5$ and $SEL_6$ are sequentially selected at consecutive time slots, so that the signals R2, G2 and B2 are written into the pixel units $P_{41}$, $P_{51}$ and $P_{61}$, respectively, whose liquid crystal the following electric fields are applied to:

ΔV1, ΔV2 and ΔV3.

Next, when the scan line $GL_2$ is selected where the polarity signal POL is "1", the selection signals $SEL_4$, $SEL_5$ and $SEL_6$ are sequentially selected at consecutive time slots, so that the signals R2, G2 and B2 are written into the pixel units $P_{42}$, $P_{52}$ and $P_{62}$, respectively, whose liquid crystal the following electric fields are applied to:

ΔV1, ΔV2 and ΔV3.

Then, the polarity signal POL is switched from "1" to "0" while the scan line $GL_2$ (="1") is maintained, the selection signals $SEL_1$, $SEL_2$ and $SEL_3$ are sequentially selected at consecutive time slots, so that the signals R1, G1 and B1 are written into the pixel units $P_{12}$, $P_{22}$ and $P_{32}$, respectively, whose liquid crystal the following electric fields are applied to:

ΔV1, ΔV2 and ΔV3.

In an (N+1) frame as shown in FIGS. 35A through 35H, when the scan line $GL_1$ is selected where the polarity signal POL is "0", the selection signals $SEL_1$, $SEL_2$ and $SEL_3$ are sequentially selected at consecutive time slots, so that the signals R1, G1 and B1 are written into the pixel units $P_{11}$, $P_{21}$, and $P_{31}$, respectively, whose liquid crystal the following electric fields are applied to:

ΔV1, ΔV2 and ΔV3.

Then, the polarity signal POL is switched from "0" to "1" while the scan line $GL_1$ (="1") is maintained, the selection signals $SEL_4$, $SEL_5$, and $SEL_6$ are sequentially selected at consecutive time slots, so that the signals R2, G2 and B2 are written into the pixel units $P_{41}$, $P_{51}$, and $P_{61}$, respectively, whose liquid crystal the following electric fields are applied to:

ΔV1, ΔV2 and ΔV3.

Next, when the scan line $GL_2$ is selected where the polarity signal POL is "0", the selection signals $SEL_4$, $SEL_5$ and $SEL_6$ are sequentially selected at consecutive time slots, so that the signals R2, G2 and B2 are written into the pixel units $P_{42}$, $P_{52}$ and $P_{62}$, respectively, whose liquid crystal the following electric fields are applied to:

ΔV1, ΔV2 and ΔV3.

Then, the polarity signal POL is switched from "0" to "1" while the scan line $GL_2$ (="1") is maintained, the selection signals $SEL_1$, $SEL_2$ and $SEL_3$ are sequentially selected at consecutive time slots, so that the signals R1, G1 and B1 are written into the pixel units $P_{12}$, $P_{22}$ and $P_{32}$, respectively, whose liquid crystal the following electric fields are applied to:

ΔV1, ΔV2 and ΔV3.

As a result, an average electric field of the liquid crystal of each of the pixel units $P_{11}$ (R1) and $P_{41}$ (R2) for the consecutive two frames is (2·ΔV1)/2=ΔV1, thus suppressing the red error. Also, an average electric field of the liquid crystal of each of the pixel units $P_{21}$ (G1) and $P_{51}$ (G2) for the four frames is 2·ΔV2/2=ΔV2, thus suppressing the green error. Further, an average electric field of the liquid crystal of each of the pixel units $P_{31}$ (B1) and $P_{61}$ (B2) for the four frames is 2·ΔV3/2=ΔV3, thus suppressing the blue error.

In the third operation, since every two frames form one period, no substantial residual DC component exists in the liquid crystal, thus increasing the life-time of the liquid crystal. For example, a residual DC component of the liquid of the pixel unit $P_{11}$ for the consecutive two frames can be represented by $$\Delta V1-\Delta V1=0$$

In the above-mentioned third operation, the driving method for the signal lines $SL_{k+1}$, $SL_{k+2}$, $SL_{k+3}$, $SL_{k+4}$, $SL_{k+5}$ and $SL_{k+6}$ (k=6, 12, . . . , m−6) is the same as the driving method for the signal lines $SL_1$, $SL_2$, $SL_3$, $SL_4$, $SL_5$ and $SL_6$.

In the above-described second and third operations, a frame inversion driving method is carried out; however, the present invention can be applied to the second and third operations without carrying out such a frame inversion driving method, although the residual DC component cannot be compensated for.

In the above-described embodiment, the selector circuit 3 can be incorporated into a panel formed by the signal lines $SL_1, SL_2, \ldots, SL_m$, the scan lines $GL_1, GL_2, \ldots, GL_n$ and the pixel units $P_{11}, P_{12}, \ldots, P_{mn}$, while the scan line driver 1 and the signal line driver 2 can be formed by one or two flexible printed boards (TCP). Otherwise, the scan line driver 1, the signal line driver 2 and the selector circuit 3 can be incorporated into the above-mentioned panel which is, in this case, made of polycrystalline silicon formed by a low temperature CUD process.

As explained hereinabove, according to the present invention, the color errors such as the red error, the green error and the blue error as the residual DC component in liquid crystal can be suppressed.

The invention claimed is:

1. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every frame and every scan line;

a scan line driver, connected to said scan lines, for sequentially selecting said scan lines;

a signal line driver, connected to said signal lines, for time-divisionally receiving digital video signals each including a plurality of digital color signals and changing a sequence of said digital video signals including said digital color signals for every two consecutive frames to time-divisionally generate an output sequence of analog video signals including analog color signals, so that each of said analog color signals is placed exclusively at predetermined time slots of said output sequence; and a selector circuit, connected between said signal line driver and said signal lines, for time-divisionally supplying the output sequence of said analog video signals including said analog color signals to said signal lines so that said analog color signals are supplied to their corresponding signal lines, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching said digital video signals in synchronization with a plurality of consecutive ones of said latch signals;

a plurality of multiplexers, each connected to one of said data registers for time-divisionally selecting digital output signals of each of said data registers; and a plurality of digtal/analog converters, each connected to one of said multiplexers, for performing digital/analog conversions upon digital output signals of said multiplexers, wherein each of said data registers comprises:

a plurality of groups of latch circuits, each group receiving said digital color signals of one of said digital video signals in synchronization with one of said latch signals, wherein said multiplexers comprises:

a first multiplexer, connected to said groups of latch circuits, for selecting said digital color signals of one of said groups of latch circuits in synchronization with a first selection signal;

a plurality of additional latch circuits, connected to said first multiplexer, for latching said digital color signals selected by said first multiplexer; and a second multiplexer, connected to said additional latch circuits, for selecting one of said digital color signals latched by said additional latch circuits in synchronization with a second selection signal.

2. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every frame and every scan line;

a scan line driver, connected to said scan lines, for sequentially selecting said scan lines;

a signal line driver, connected to said signal lines, for time-divisionally receiving digital video signals each including first, second and third digital color signals and changing a sequence of said digital video signals including said first, second and third digital color signals for every two consecutive frames to time-divisionally generate an output sequence of analog video signals including first, second and third analog color signals, so that each of said first, second and third analog color signals is placed exclusively at predetermined time slots of said output sequence; and a selector circuit, connected between said signal line driver and said signal lines, for time-divisionally supplying the output sequence of said analog video signals including said first, second and third analog color signals to said signal lines so that said first, second and third analog color signals are supplied to their corresponding signal lines, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching two consecutive ones of said digital video signals in synchronization with two consecutive ones of said latch signals;

a plurality of 6-to-1 multiplexers, each connected to one of said data registers for time-divisionally selecting digital output signals of each of said data registers; and a plurality of digital/analog converters, each connected to one of said 6-to-1 multiplexers, for performing digital/analog conversions upon digital output signals of said 6-to-1 multiplexers, wherein each of said data registers comprises:

first, second and third latch circuits, each receiving said first, second and third digital color signals of one of said digital video signals in synchronization with one of said latch signals; and fourth, fifth and sixth latch circuits, each receiving said first, second and third digital color signals of another of said digital video signals in synchronization with another of said latch signals subsequent to said one of said latch signals, wherein said 6-to-i multiplexers comprises:

a 6-to-3 multiplexer, connected to said first, second, third, fourth, fifth and sixth latch circuits, for selecting said first, second and third digital color signals of said first, second and third latch circuits or said fourth, fifth and sixth latch circuits in synchronization with a first selection signal;

seventh, eighth and ninth latch circuits, connected to said 6-to-3 multiplexer, for latching said first, second and third digital color signals selected by said 6-to-3 multiplexer; and a 2-to-1 multiplexer, connected to said seventh, eighth and ninth latch circuits, for selecting one of said first, second and third digital color signals latched by said seventh, eighth and ninth latch circuits in synchronization with a second selection signal.

3. The liquid crystal display apparatus as set forth in claim 2, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

4. The liquid crystal display apparatus as set forth in claim 2, wherein said first analog color signal is placed at one of first and second time slots of said output sequence, said second analog color signal is placed at one of third and fourth time slots of said output sequence, and said third analog color signal is placed at one of fifth and sixth time slots of said output sequence.

5. The liquid crystal display apparatus as set forth in claim 2, wherein said first analog color signal is placed at one of first and second time slots of said output sequence, said second analog color signal is placed at one of third and sixth time slots of said output sequence, and said third analog color signal is placed at one of fourth and fifth time slots of said output sequence.

6. The liquid crystal display apparatus as set forth in claim 2, wherein said first analog color signal is placed at one of first and third time slots of said output sequence, said second analog color signal is placed at one of second and fourth time slots of said output sequence, and said third analog color signal is placed at one of fifth and sixth time slots of said output sequence.

7. The liquid crystal display apparatus as set forth in claim 2, wherein said first analog color signal is placed at one of first and third time slots of said output sequence, said second analog color signal is placed at one of second and sixth time slots of said output sequence, and said third analog color signal is placed at one of fourth and sixth time slots of said output sequence.

8. The liquid crystal display apparatus as set forth in claim 2, wherein said first analog color signal is placed at one of first and fourth time slots of said output sequence, said second analog color signal is placed at one of second and sixth time slots of said output sequence, and said third analog color signal is placed at one of third and fifth time slots of said output sequence.

9. The liquid crystal display apparatus as set forth in claim 2, wherein said first analog color signal is placed at one of first and fifth time slots of said output sequence, said second analog color signal is placed at one of second and sixth time slots of said output sequence, and said third analog color signal is placed at one of third and fourth time slots of said output sequence.

10. The liquid crystal display apparatus as set forth in claim 2, wherein said first analog color signal is placed at one of first and fifth time slots of said output sequence, said second analog color signal is placed at one of second and fourth time slots of said output sequence, and said third analog color signal is placed at one of third and sixth time slots of said output sequence.

11. The liquid crystal display apparatus as set forth in claim 2, wherein said first analog color signal is placed at one of first and sixth time slots of said output sequence, said second analog color signal is placed at one of second and fifth time slots of said output sequence, and said third analog color signal is placed at one of third and fourth time slots of said output sequence.

12. The liquid crystal display apparatus as set forth in claim 2, wherein said first analog color signal is placed at one of first and sixth time slots of said output sequence, said second analog color signal is placed at one of second and fourth time slots of said output sequence, and said third analog color signal is placed at one of third and fifth time slots of said output sequence.

13. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every predetermined number of signal lines;

a scan line driver, connected to said scan lines, for sequentially selecting said scan lines;

a signal line driver, connected to said signal lines, for time-divisionally receiving digital video signals each including a predetermined number of digital color signals to time-divisionally generate an output sequence of analog video signals including analog color signals, so that each of said analog color signals is placed exclusively at a predetermined time slot of said output sequence; and a selector circuit, connected between said signal line driver and said signal lines, for time-divisionally supplying the output sequence of said analog video signals including said analog color signals to said signal lines so that said analog color signals are supplied to their corresponding signal lines, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching said digital video signals in synchronization with a plurality of consecutive ones of said latch signals;

a plurality of multiplexers, each connected to one of said data registers for time-divisionally selecting digital output signals of each of said data registers; and a plurality of digital/analog converters, each connected to one of said multiplexers, for performing digital/analog conversions upon digital output signals of said multiplexers, wherein each of said data registers comprises:

a plurality of groups of latch circuits, each group receiving said digital color signals of one of said digital video signals in synchronization with one of said latch signals, wherein each of said multiplexers comprises:

a first multiplexer, connected to said groups of latch circuits, for selecting said digital color signals of one of said groups of latch circuits in synchronization with a first selection signal;

a plurality of additional latch circuits, connected to said first multiplexer, for latching said digital color signals selected by said first multiplexer; and a second multiplexer, connected to said additional latch circuits, for selecting one of said digital color signals latched by said additional latch circuits in synchronization with a second selection signal.

14. The liquid crystal display apparatus as set forth in claim 13, wherein said common voltage generating circuit further inverts said common voltage for every frame.

15. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every three signal lines;

a scan line driver, connected to said scan lines, for sequentially selecting said scan lines;

a signal line driver, connected to said signal lines, for time-divisionally receiving digital video signals each including first, second and third digital color signals to time-divisionally generate an output sequence of analog video signals including first, second and third analog color signals, so that each of said first, second and third analog color signals is placed exclusively at a predetermined time slot of said output sequence; and a selector circuit, connected between said signal line driver and said signal lines, for time-divisionally supplying the output sequence of said analog video signals including said first, second and third analog color signals to said signal lines so that said first, second and third analog color signals are supplied to their corresponding signal lines, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching two consecutive ones of said digital video signals in synchronization with two consecutive ones of said latch signals;

a plurality of 6-to-1 multiplexers, each connected to one of said data registers for time-divisionally selecting digital output signals of each of said data registers; and a plurality of digital/analog converters, each connected to one of said 6-to-1 multiplexers, for performing digital/analog conversions upon digital output signals of said 6-to-1 multiplexers, wherein each of said data registers comprises:

first, second and third latch circuits, each receiving said first, second and third digital color signals of one of said digital video signals in synchronization with one of said latch signals; and fourth, fifth and sixth latch circuits, each receiving said first, second and third digital color signals of another of said digital video signals in synchronization with another of said latch signals subsequent to said one of said latch signals, wherein each of said 6-to-1 multiplexers comprises:

a 6-to-3 multiplexer, connected to said first, second, third, fourth, fifth and sixth latch circuits, for selecting said first, second and third digital color signals of said first, second and third latch circuits or said fourth, fifth and sixth latch circuits in synchronization with a first selection signal;

seventh, eighth and ninth latch circuits, connected to said 6-to-3 multiplexer, for latching said first, second and third digital color signals selected by said 6-to-3 multiplexer; and a 2-to-1 multiplexer, connected to said seventh, eighth and ninth latch circuits, for selecting one of said first, second and third digital color signals latched by said seventh, eighth and ninth latch circuits in synchronization with a second selection signal.

16. The liquid crystal display apparatus as set forth in claim 15, wherein said common voltage generating circuit further inverts said common voltage for every frame.

17. The liquid crystal display apparatus as set forth in claim 15, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

18. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every predetermined number of signal lines;

a scan line driver, connected to said scan lines, for sequentially selecting said scan lines;

a signal line driver, connected to said signal lines, for time-divisionally receiving digital video signals each including said predetermined number of digital color signals and changing a sequence of every two consecutive digital video signals for every scan line to time-divisionally generate an output sequence of analog video signals including analog color signals, so that each of said analog color signals is placed exclusively at predetermined time slots of said output sequence; and a selector circuit, connected between said signal line driver and said signal lines, for time-divisionally supplying the output sequence of said analog video signals including said analog color signals to said signal lines so that said analog color signals are supplied to their corresponding signal lines, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching said digital video signals in synchronization with a plurality of consecutive ones of said latch signals;

a plurality of multiplexers, each connected to one of said data registers for time-divisionally selecting digital output signals of each of said data registers; and a plurality of digital/analog converters, each connected to one of said multiplexers, for performing digital/analog conversions upon digital output signals of said multiplexers, wherein each of said data registers comprises:

a plurality of groups of latch circuits, each group receiving said digital color signals of one of said digital video signals in synchronization with one of said latch signals, wherein said multiplexers comprises:

a first multiplexer, connected to said groups of latch circuits, for selecting said digital color signals of one of said groups of latch circuits in synchronization with a first selection signal;

a plurality of additional latch circuits, connected to said first multiplexer, for latching said digital color signals selected by said first multiplexer; and a second multiplexer, connected to said additional latch circuits, for selecting one of said digital color signals latched by said additional latch circuits in synchronization with a second selection signal.

19. The liquid crystal display apparatus as set forth in claim 18, wherein said common voltage generating circuit further inverts said common voltage for every frame.

20. A common inversion type liquid crystal display apparatus comprising:

a plurality of signal lines;

a plurality of scan lines;

a common electrode;

a plurality of pixel units located at intersections between said signal lines and said scan lines and connected to said common electrode;

a common voltage generating circuit, connected to said common electrode, for inverting a common voltage applied to said common electrode for every three signal lines;

a scan line driver, connected to said scan lines, for sequentially selecting said scan lines;

a signal line driver, connected to said signal lines, for time-divisionally receiving digital video signals each including first, second and third digital color signals and changing a sequence of every two consecutive digital video signals for every scan line to time-divisionally generate an output sequence of analog video signals including first, second and third analog color signals, so that each of said first, second and third analog color signals is placed exclusively at predetermined time slots of said output sequence; and a selector circuit, connected between said signal line driver and said signal lines, for time-divisionally supplying the output sequence of said analog video signals including said first, second and third analog color signals to said signal lines so that said first, second and third analog color signals are supplied to their corresponding signal lines, wherein said signal line driver comprises:

a horizontal shift register circuit for shifting a horizontal start pulse signal in synchronization with a horizontal clock signal to generate latch signals, a plurality of data registers connected to said horizontal shift register circuit, each of said data registers latching two consecutive ones of said digital video signals in synchronization with two consecutive ones of said latch signals;

a plurality of 6-to-1 multiplexers, each connected to one of said data registers for time-divisionally selecting digital output signals of each of said data registers; and a plurality of digital/analog converters, each connected to one of said 6-to-1 multiplexers, for performing digital/analog conversions upon digital output signals of said 6-to-1 multiplexers, wherein said signal line driver comprises:

a horizontal shift register circuit for shifting a horizontal start pulse signal in synchronization with a horizontal clock signal to generate latch signals;

a plurality of data registers connected to said horizontal shift register circuit, each of said data registers latching two consecutive ones of said digital video signals in synchronization with two consecutive ones of said latch signals;

a plurality of 6-to-1 multiplexers, each connected to one of said data registers for time-divisionally selecting digital output signals of each of said data registers; and a plurality of digital/analog converters, each connected to one of said 6-to-1 multiplexers, for performing digital/analog conversions upon digital output signals of said 6-to-1 multiplexers, wherein each of said 6-to-1 multiplexers comprises:

a 6-to-3 multiplexer, connected to said first, second, third, fourth, fifth and sixth latch circuits, for selecting said first, second and third digital color signals of said first, second and third latch circuits or said fourth, fifth and sixth latch circuits in synchronization with a first selection signal;

seventh, eighth and ninth latch circuits, connected to said 6-to-3 multiplexer, for latching said first, second and third digital color signals selected by said 6-to-3 multiplexer; and a 2-to-1 multiplexer, connected to said seventh, eighth and ninth latch circuits, for selecting one of said first, second and third digital color signals latched by said seventh, eighth and ninth latch circuits in synchronization with a second selection signal.

21. The liquid crystal display apparatus as set forth in claim 20, wherein said common voltage generating circuit further inverts said common voltage for every frame.

22. The liquid crystal display apparatus as set forth in claim 20, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

23. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

changing a common voltage applied to said common electrode for every frame and every scan line;

time-divisionally receiving digital video signals each including a plurality of digital color signals while one of said scan lines is selected;

changing a sequence of said digital video signals including said digital color signals for every two consecutive frames to generate an output sequence of analog video signals including analog color signals, so that each of said analog color signals is located exclusively at predetermined time slots of said output sequence; and time-divisionally supplying the output sequence of said analog video signals including said analog color signals to said signal lines so that said analog color signals are supplied to their corresponding signal lines, wherein the time-divisionally-receiving step comprises:

shifting, by a horizontal shift register, a horizontal start pulse signal in synchronization with a horizontal clock signal to generate latch signals;

latching, by a plurality of data registers connected to said horizontal shift register circuit, said digital video signals in synchronization with a plurality of consecutive ones of said latch signals;

time-divisionally selecting, by a plurality of multiplexers each connected to one of said data registers, digital output signals of each of said data registers; and performing, by a plurality of digital/analog converters each connected to one of said multiplexers, digital/analog conversions upon digital output signals of said multiplexers, wherein the latching step comprises:

receiving, by a plurality of groups of latch circuits, said digital color signals of one of said digital video signals in synchronization with one of said latch signals, wherein the time-divisionally selecting step comprises:

selecting, by a first multiplexer connected to said groups of latch circuits, said digital color signals of one of said groups of latch circuits in synchronization with a first selection signal;

latching, by a plurality of additional latch circuits, said digital color signals selected by said first multiplexer; and selecting, by a second multiplexer connected to said additional latch circuits, one of said digital color signals latched by said additional latch circuits in synchronization with a second selection signal.

24. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

inverting a common voltage applied to said common electrode for every frame and every scan line;

time-divisionally receiving digital video signals each including first, second and third digital color signals while one of said scan lines is selected;

changing a sequence of said digital video signals including said first, second and third digital color signals for every two consecutive frames to generate an output sequence of analog video signals including first, second and third analog color signals, so that each of said first, second and third analog color signals is placed exclusively at predetermined time slots of said output sequence; and time-divisionally supplying the output sequence of said analog video signals including said first, second and third analog color signals to said signal lines so that said first, second and third analog color signals are supplied to their corresponding signal lines, wherein the time-divisionally-receiving step comprises:

shifting, by a horizontal shift register, a horizontal start pulse signal in synchronization with a horizontal clock signal to generate latch signals;

latching, by a plurality of data registers connected to said horizontal shift register circuit, said digital video signals in synchronization with a plurality of consecutive ones of said latch signals;

time-divisionally selecting, by a plurality of 6-1 multiplexers each connected to one of said data registers, digital output signals of each of said data registers; and performing, by a plurality of digital/analog converters each connected to one of said multiplexers, digital/analog conversions upon digital output signals of said multiplexers, wherein the latching step comprises:

receiving, by first, second and third latch circuits each receiving said first, second and third digital color signals of one of said digital video signals in synchronization with one of said latch signals; and receiving, by fourth, fifth and sixth latch circuits each receiving said first, second and third digital color signals of another of said digital video signals in synchronization with another of said latch signals subsequent to said one of said latch signals, wherein the time-divisionally selecting step comprises:

selecting, by a 6-to-3 multiplexer connected to said first, second, third, fourth, fifth and sixth latch circuits, said first, second and third digital color signals of said first, second and third latch circuits or said fourth, fifth and sixth latch circuits in synchronization with a first selection signal;

latching, by seventh, eighth and ninth latch circuits each connected to said 6-3 multiplexer, said first, second and third digital color signals selected by said 6-3 multiplexer; and selecting, by a 2-to-1 multiplexer connected to said seventh, eighth and ninth latch circuits, one of said first, second and third digital color signals latched by said seventh, eighth and ninth latch circuits in synchronization with a second selection signal.

25. The method as set forth in claim 24, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

26. The method as set forth in claim 24, wherein said first analog color signal is placed at one of first and second time slots of said output sequence, said second analog color signal is placed at one of third and fourth time slots of said output sequence, and said third analog color signal is placed at one of fifth and sixth time slots of said output sequence.

27. The method as set forth in claim 24, wherein said first analog color signal is placed at one of first and second time slots of said output sequence, said second analog color signal is placed at one of third and sixth time slots of said output sequence, and said third analog color signal is placed at one of fourth and fifth time slots of said output sequence.

28. The method as set forth in claim 24, wherein said first analog color signal is placed at one of first and third time slots of said output sequence, said second analog color signal is placed at one of second and fourth time slots of said output sequence, and said third analog color signal is placed at one of fifth and sixth time slots of said output sequence.

29. The method as set forth in claim 24, wherein said first analog color signal is placed at one of first and third time slots of said output sequence, said second analog color signal is placed at one of second and sixth time slots of said output sequence, and said third analog color signal is placed at one of fourth and sixth time slots of said output sequence.

30. The method as set forth in claim 24, wherein said first analog color signal is placed at one of first and fourth time slots of said output sequence, said second analog color signal is placed at one of second and sixth time slots of said output sequence, and said third analog color signal is placed at one of third and fifth time slots of said output sequence.

31. The method as set forth in claim 24, wherein said first analog color signal is placed at one of first and fifth time slots of said output sequence, said second analog color signal is placed at one of second and sixth time slots of said output sequence, and said third analog color signal is placed at one of third and fourth time slots of said output sequence.

32. The method as set forth in claim 24, wherein said first analog color signal is placed at one of first and fifth time slots of said output sequence, said second analog color signal is placed at one of second and fourth time slots of said output sequence, and said third analog color signal is placed at one of third and sixth time slots of said output sequence.

33. The method as set forth in claim 24, wherein said first analog color signal is placed at one of first and sixth time slots of said output sequence, said second analog color signal is placed at one of second and fifth time slots of said output sequence, and said third analog color signal is placed at one of third and fourth time slots of said output sequence.

34. The method as set forth in claim 24, wherein said first analog color signal is placed at one of first and sixth time slots of said output sequence, said second analog color signal is placed at one of second and fourth time slots of said output sequence, and said third analog color signal is placed at one of third and fifth time slots of said output sequence.

35. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

inverting a common voltage applied to said common electrode for every three signal lines;

time-divisionally receiving digital video signals each including a plurality of digital color signals while one of said scan lines is selected, to generate an output sequence of analog video signals including analog color signals, so that each of said analog color signals is placed exclusively at a predetermined time slot of said output sequence; and time-divisionally supplying the output sequence of said analog video signals including said analog color signals to said signal lines so that said analog color signals are supplied to their corresponding signal lines, wherein the time-divisionally-receiving step comprises:

shifting, by a horizontal shift register circuit, a horizontal start pulse signal in synchronization with a horizontal clock signal to generate latch signals;

latching, by a plurality of data registers connected to said horizontal shift register circuit, said digital video signals in synchronization with a plurality of consecutive ones of said latch signals;

time-divisionally selecting, by a plurality of multiplexers each connected to one of said data registers, digital output signals of each of said data registers; and performing, by a plurality of digital/analog converters each connected to one of said multiplexers, digital/analog conversions upon digital output signals of said multiplexers, wherein the latching step comprises:

receiving, by a plurality of groups of latch circuits, said digital color signals of one of said digital video signals in synchronization with one of said latch signals, wherein the time-divisionally selecting step comprises:

selecting, by a first multiplexer connected to said groups of latch circuits, said digital color signals of one of said groups of latch circuits in synchronization with a first selection signal:

latching, by a plurality of additional latch circuits connected to said first multiplexer, said digital color signals selected by said first multiplexer; and selecting, by a second multiplexer connected to said additional latch circuits, one of said digital color signals latched by said additional latch circuits in synchronization with a second selection signal.

36. The method as set forth in claim 35, further inverting said common voltage for every frame.

37. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

inverting a common voltage applied to said common electrode for every three signal lines;

time-divisionally receiving digital video signals each including first, second and third digital color signals while one of said scan lines is selected, to generate an output sequence of analog video signals including first, second and third analog color signals, so that each of said first, second and third analog color signals is placed exclusively at a predetermined time slot of said output sequence; and time-divisionally supplying the output sequence of said analog video signals including said first, second and third analog color signals to said signal lines so that said first, second and third analog color signals are supplied to their corresponding signal lines, wherein the time-divisionally-receiving step comprises:

shifting, by a horizontal shift register circuit, a horizontal start pulse signal in synchronization with a horizontal clock signal to generate latch signals:

latching, by a plurality of data registers connected to said horizontal shift register circuit, two consecutive ones of said digital video signals in synchronization with two consecutive ones of said latch signals:

time-divisionally selecting, by a plurality of 6-to-1 multiplexers each connected to one of said data registers, digital output signals of each of said data registers; and performing, by a plurality of digital/analog converters each connected to one of said 6-to-1 multiplexers, digital/analog conversions upon digital output signals of said 6-to-1 multiplexers, wherein the latching step comprises:

receiving, by first, second and third latch circuits, said first, second and third digital color signals of one of said digital video signals in synchronization with one of said latch signals; and receiving, by fourth, fifth and sixth latch circuits, said first, second and third digital color signals of another of said digital video signals in synchronization with another of said latch signals subsequent to said one of said latch signals, wherein the time-divisionally selecting step comprises:

selecting, by a 6-to-3 multiplexer connected to said first, second, third, fourth, fifth and sixth latch circuits, said first, second and third digital color signals of said first, second and third latch circuits or said fourth, fifth and sixth latch circuits in synchronization with a first selection signal;

latching, by seventh, eighth and ninth latch circuits connected to said 6-to-3 multiplexer, said first, second and third digital color signals selected by said 6-to-3 multiplexer; and selecting, by a 2-to-1 multiplexer connected to said seventh, eighth and ninth latch circuits, one of said first, second and third digital color signals latched by said seventh, eighth and ninth latch circuits in synchronization with a second selection signal.

38. The method as set forth in claim 37, further inverting said common voltage for every frame.

39. The method as set forth in claim 37, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

40. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

inverting a common voltage applied to said common electrode for every predetermined number of signal lines;

time-divisionally receiving digital video signals each including said predetermined number of digital color signals and changing a sequence of every two consecutive digital video signals for every scan line while one of said scan lines is selected, to time-divisionally generate an output sequence of analog video signals including analog color signals, so that each of said analog color signals is placed exclusively at predetermined time slots of said output sequence; and time-divisionally supplying the output sequence of said analog video signals including said analog color signals to said signal lines so that said analog color signals are supplied to their corresponding signal lines, wherein the time-divisionally-receiving step comprises:

shifting, by a horizontal shift register circuit, a horizontal start pulse signal in synchronization with a horizontal clock signal to generate latch signals;

latching, by a plurality of data registers connected to said horizontal shift register circuit, said digital video signals in synchronization with a plurality of consecutive ones of said latch signals;

time-divisionally selecting, by a plurality of multiplexers each connected to one of said data registers, digital output signals of each of said data registers; and performing, by a plurality of digital/analog converters each connected to one of said multiplexers, digital/analog conversions upon digital output signals of said multiplexers, wherein the latching step comprises:

receiving, by a plurality of groups of latch circuits, said digital color signals of one of said digital video signals in synchronization with one of said latch signals, wherein the time-divisionally selecting step comprises:

selecting, by a first multiplexer connected to said groups of latch circuits, said digital color signals of one of said groups of latch circuits in synchronization with a first selection signal;

latching, by a plurality of additional latch circuits connected to said first multiplexer, said digital color signals selected by said first multiplexer; and selecting, by a second multiplexer connected to said additional latch circuits, one of said digital color signals latched by said additional latch circuits in synchronization with a second selection signal.

41. The method as set forth in claim 40, further inverting said common voltage for every frame.

42. A method for driving a common inversion type liquid crystal display apparatus including a plurality of signal lines, a plurality of scan lines, a common electrode, and a plurality of pixel units located at intersections between said signal lines and said scan lines and connected to said common electrode, comprising:

inverting a common voltage applied to said common electrode for every three signal lines;

time-divisionally receiving digital video signals each including first, second and third digital color signals and changing a sequence of every two consecutive digital video signals for every scan line while one of said scan lines is selected, to time-divisionally generate an output sequence of analog video signals including first, second and third analog color signals, so that each of said first, second and third analog color signals is placed exclusively at predetermined time slots of said output sequence; and time-divisionally supplying the output sequence of said analog video signals including said first, second and third analog color signals to said signal lines so that said first, second and third analog color signals are supplied to their corresponding signal lines, wherein the time-divisionally-receiving step comprises:

shifting, by a horizontal shift register circuit, a horizontal start pulse signal in synchronization with a horizontal clock signal to generate latch signals;

latching, by a plurality of data registers connected to said horizontal shift register circuit, two consecutive ones of said digital video signals in synchronization with two consecutive ones of said latch signals;

time-divisionally selecting, by a plurality of 6-to-1 multiplexers each connected to one of said data registers, digital output signals of each of said data registers: and performing, by a plurality of digital/analog converters each connected to one of said 6-to-1 multiplexers, digital/analog conversions upon digital output signals of said 6-to-1 multiplexers, wherein the latching step comprises:

shifting, by a horizontal shift register circuit, a horizontal start pulse signal in synchronization with a horizontal clock signal to generate latch signals;

latching, by a plurality of data registers connected to said horizontal shift register circuit, two consecutive ones of said digital video signals in synchronization with two consecutive ones of said latch signals;

time-divisionally selecting, by a plurality of 6-to-1 multiplexers each connected to one of said data registers, digital output signals of each of said data registers; and performing, by a plurality of digital/analog converters each connected to one of said 6-to-1 multiplexers, digital/analog conversions upon digital output signals of said 6-to-1 multiplexers, wherein the time-divisionally selecting step comprises:

selecting, by a 6-to-3 multiplexer connected to said first, second, third, fourth, fifth and sixth latch circuits, said first, second and third digital color signals of said first, second and third latch circuits or said fourth, fifth and sixth latch circuits in synchronization with a first selection signal;

latching, by seventh, eighth and ninth latch circuits connected to said 6-to-3 multiplexer, said first, second and third digital color signals selected by said 6-to-3 multiplexer; and selecting, by a 2-to-1 multiplexer connected to said seventh, eighth and ninth latch circuits, one of said first, second and third digital color signals latched by said seventh, eighth and ninth latch circuits in synchronization with a second selection signal.

43. The method as set forth in claim 42, further inverting said common voltage for every frame.

44. The method as set forth in claim 42, wherein said first analog color signal is placed at one of first and fourth time slots of said output sequence, said second analog color signal is placed at one of second and fifth time slots of said output sequence, and said third analog color signal is placed at one of third and sixth time slots of said output sequence.

* * * * *